United States Patent [19]

Sugimoto et al.

[11] 4,376,478

[45] Mar. 15, 1983

[54] CONTROL DEVICE FOR A VENDING MACHINE INCLUDING SYSTEM FOR CONFIRMING VENDIBILITY OF SELECTED ARTICLES

[75] Inventors: Osamu Sugimoto; Masaki Akagawa, both of Sakado, Japan

[73] Assignee: Kabushiki Kaisha Nippon Coinco, Tokyo, Japan

[21] Appl. No.: 196,073

[22] Filed: Oct. 10, 1980

[30] Foreign Application Priority Data

Oct. 16, 1979 [JP] Japan ..... 54/133311

[51] Int. Cl.[3] ..... G07F 5/16

[52] U.S. Cl. ..... 194/1 N; 221/125

[58] Field of Search ..... 194/1 R, 1 M, 1 N, 2, 194/10; 221/92, 123, 124, 125, 129, 15; 235/92 CN

[56] References Cited

U.S. PATENT DOCUMENTS 3,691,431 9/1972 Hendricksen et al. ..... 221/125 X
3,815,720 6/1974 Machanian et al. ..... 194/1 N X
3,894,220 7/1975 Levasseur ..... 194/1 NX
4,143,749 3/1979 Otten ..... 194/1 N
4,267,915 5/1981 McLaughlin et al. ..... 194/1 N

*Primary Examiner*—Stanley H. Tollberg
*Attorney, Agent, or Firm*—Spensley, Horn, Jubas & Lubitz

[57] ABSTRACT

A vending control system for sequentially carrying out a first and second operation in order to insure that the selected article is in fact vendible and that the correct amount of change is provided. During the first operation, the amount of deposited coins is compared with the vend price of all articles in order to determine which articles are vendible, and article selection switches corresponding to the vendible articles are enabled. And during the second operation, the amount of deposited coins is compared with the vend price of an article selected by operation of the corresponding article selection switch, in order to confirm that the selected article is in fact vendible and to insure that the proper amount of change is provided.

9 Claims, 19 Drawing Figures

CONTROL DEVICE FOR A VENDING MACHINE INCLUDING SYSTEM FOR CONFIRMING VENDIBILITY OF SELECTED ARTICLES

SUMMARY OF THE INVENTION

This invention relates to a control device for a vending machine.

In a prior art control device for a vending machine (e.g. a control device disclosed in the specification of U.S. Pat. No. 4,109,775), confirmation as to whether a selected article is vendible or not is no longer made once a vend possible signal (or signals) indicating an article which is vendible within the amount of deposited coins has been delivered out on a vend circuit (or circuits) provided on a vender mechanism side. The vend circuit drives a drive unit to dispense the article and simultaneously delivers a vend start signal to a control device provided on a coin changer mechanism side on condition that a vend possible signal corresponding to the selected article is provided. After producing the vend possible signal, the control device waits for generation of the vend start signal and, in accordance with this vend start signal, effects a money collection operation of subtracting the vend price from the amount of deposited coins. Since the judgement as to whether a selected article is vendible or not is made only once in the prior art control device, inconvenience arise on such occasions as when vending of an article is restricted due to shortage of change coins. Vending machines are usually so constructed that in case of change coin shortage, vending is possible only if coin or coins of the same amount as a vend price are deposited and vending is prohibited if a coin or coins the amount of which exceeds the vend price and therefore requires change are deposited. If the judgement as to whether an article is vendible or not is made only once, the condition that the amount of deposited coins is equal to the vend price is satisfied in the course of feeding coins into the vending machine and the judgement that vending is possible can no longer be cancelled even if requirement for paying change should arise by additional feeding of coins into the vending machine. Besides, protection against an erroneous operation which may take place in the transmission of a signal representing a vendible article or a signal representing an article has been selected is insufficient in the prior art control device in which the judgement as to vendibility is made only once.

It is, therefore, an object of the present invention to provide a control device for a vending machine capable of effecting a control operation which is perfect and elaborate from the standpoint of safety for preventing occurrence of the above described inconveniences or erroneous operation. This object is achieved by sequentially carrying out a first operation for comparing the amount of deposited coins with vend prices of all articles, producing vend possible signal or signals corresponding to a vendible article or articles in accordance with the comparison and making effective operation of an article selection switch or switches corresponding to the vend possible signal or signals and a second operation for comparing, to confirm that the selected article is really vendible, the amount of the deposited coins with the vend price of a single article selected by operation of any one of the article selection switches the opeations of which have been made effective by the first operation and effecting dispensing of the selected article and collection of the vend price of the article only if the article has been found vendible as a result of the comparison. In the description of a preferred embodiment of the invention to be made later, the comparison between the vend prices of all articles and the amount of deposited coins made in the first operation will be referred to as "first comparison", whereas the comparison between the vend price of a single selected article and the amount of deposited coins made in the second operation will be referred to as "second comparison". According to the present invention, therefore, the judgement as to whether an article is vendible or not is made twice by the "first comparison" and the "second comparison" in a single vending and an actual vending operation (i.e., collection of the vend price and dispensing of the article) is started only when it has been reconfirmed by the "second comparison" that the selected article is vendible, so that an accurate vending operation without likelihood of occurrence of an erroneous operation is ensured.

It is known in the art that a control device for a vending machine includes an up-down counter circuit for adding amounts of deposited coins and subtracting a vend price or change to be paid out and a comparator circuit for comparing the amount of deposited coins counted by this counter circuit with vend prices to judge vendibility of articles. In the present invention, circuits relating to such coin changing control are all provided in a coin control unit and a vend control unit implementing the above described first and second operations are newly provided separately from this coin control unit. The vend control unit includes a vend price delivery circuit for delivering signals representing set vend prices of all articles to the comparator circuit for the comparison with the amount of deposited coins during the first operation and delivering only a signal representing a vend price of a single article selected by an article selection signal to the comparator circuit for comparison with the amount of deposited coins, a vend possible signal delivery circuit for delivering vend possible signal or signals corresponding to one or more articles which have been found vendible as a result of the comparison made by the comparator circuit during the first operation, a vend drive signal delivering circuit for delivering a vend drive signal corresponding to the single article which has been found vendible as a result of the comparison made by the comparator circuti during the second operation and driving an article dispensing drive unit by this vend drive signal to dispense the selected article and an operation control circuit for judging whether the first operation is to be made or the second operation is to be made and controls the respective signal delivery means in accordance with this judgement.

By way of example, the operation control circuit judges whether the first operation is to be made or the second operation is to be made depending upon whether the article selection switch or switches have been effectively operated or not. In an embodiment of the present invention to be described with reference to the accompanying drawings, SD flip-flops 48-1 through 48-n and a circuit portion in the vicinity thereof correspond to the operation control circuit, a memory and delivery circuit 29 corresponds to the vend price signal delivery circuit, SD flip-flops 32-1 through 32-n and a circuit portion in the vicinity thereof and AND gaes 35-1 through 35-n correspond to the vend possible signal delivery circuit and AND gates 66-1 through 66-n and 67-1 through 67-n and memory circuits 72-1 through 72-n correspond to the vend dirve signal delivery circuit.

It is another object of the present invention to provide a control device in which all constituent elements of the control device for a vending machine are arranged in any one of three parts of a coin control unit, a vend control unit and a vend circuit (a portion including an article dispensing drive unit and selection switches) and these parts are connected by wirings of a minimum possible number and, if necessity arises, any one of these parts can be readily changed by replacing such part as a whole.

It is still another object of the invention to provide a control device capable of watching whether the article dispensing drive unit can be properly driven or not (i.e. whether there is no malfunctioning) and preventing occurrence of an erroneous operation by taking a suitable action on the vend control side in case of malfunctioning of the article dispensing drive unit. This object of the invention is achieved by constantly supplying the article dispensing drive unit with a small current which is not sufficient to drive the drive unit, detecting malfunction by watching presence or absence of the small current and, if malfunction has been detected, prohibiting delivery in the vend control unit of the vend possible signal and vend drive signal corresponding to the article with respect to which the malfunction has occurred.

DESCRIPTION OF PREFERRED EMBODIMENTS

Figure 1:
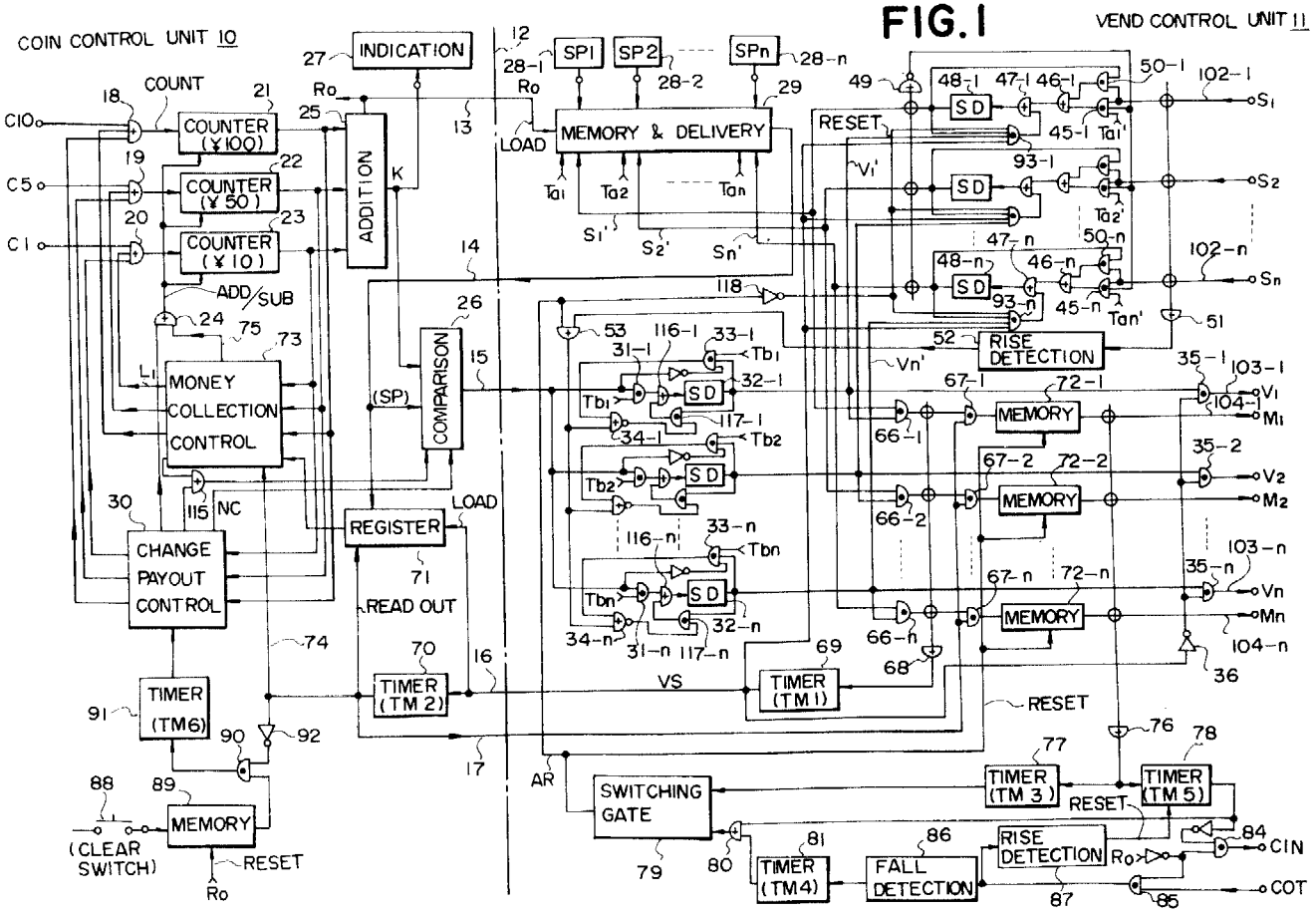
FIG. 1 is a block digram showing an embodiment of the present invention.

Referring first to FIG. 1, a coin control unit 10 and a vend control unit 11 in a vending machine divided by a chain-and-dot line 12 are operated asynchronously with each other. The coin control unit 10 counts an amount of deposited coins (or bills), compares the counted amount with a vend price of a selected article and pays out a change, if any, after collecting the amount equivalent to the vend price from the amount of the deposited coins. The counting and other operations of the coin control unit 10 are controlled by a clock pulse or a working pulse of a high rate in the order of microseconds. The vend control unit 11 delivers out a vend possible signal to an article selection switch of the vending machine in accordance with the comparison conducted by the coin control unit 10 and delivers, upon receipt of an article selection signal from the article selection switch, an article dispense signal to an article dispensing drive unit (solenoid or motor) which dispenses the selected article and also delivers a memory collection command signal or a change payout command signal to the coin control unit 10. The operations of the vend control unit 11 are controlled by a clock pulse of a low rate in the order of milliseconds which is asynchronous with the high rate clock pulse used in the coin control unit 10. In the embodiment of FIG. 1, blocks representing main circuit functions only are shown. In the actual vending machines, however, various known circuits functions such as a circuit for controlling an operation timing, a malfunction detection circuit and a safety circuit are added to the circuit functions shown in FIG. 1. If space is available in the vending machine, both control units 10 and 11 may be built on the same integral circuit chip or the same circuit board. It is, however, difficult or undesirable to build the control device consisting of the two control units 10 and 11 on the same chip or circuit board on account of arrangements of a coin changer mechanism and a vend mechanism (i.e., the article selection switch and the article dispensing drive unit) or other space relations. In such case, the two control units 10 and 11 are separated from each other and the coin control unit 10 is mounted on the coin changer side (not shown) and the vend control unit 11 on the vend mechanism side (not shown), and lines 13, 14, 15, 16 and 17 connecting the two control units 10 and 11 are provided by means of wiring. Since the two units 10 and 11 are operated asynchronously with each other and besides the number of lines is relatively small (only 13 to 17), the two control units 10 and 11 may be separated without any difficulty.

Upon deposition of a coin a coin pulse among coin pulses C10, C5 and C1 corresponding to the denomination of the deposited coin is generated by a coin detector (not shown) and is applied through an OR gate 18, 19 or 20 of the coin control unit 10 to an up-down counter 21, 22, or 23 provided for respective denominations. The output of an OR gate 24 applied to up-down counting control inputs of the up-down counter 21, 22 and 23 is normally "0", this "0" instructing addition and an output "1" of the OR gate 24 instructing subtraction. Accordingly, the coin pulses C10, C5 and C1 corresponding to respective deposited coins are counted up in the counters 21, 22 and 23 and the amount of the deposited coins is obtained, denomination by denomination, by a corresponding one of the counters 21, 22 and 23. For instance, the counter 21 corresponds to 100, the counter 22 to 50 and the counter 23 to 10. If a bank bill (e.g 1,000) is to be deposited, a counter for counting the bank bill is additionally provided.

The counting output of the counters 21, 22 and 23 are applied to an addition circuit 25 in which a sum of the amounts of the deposited coins is computed. A signal representing a sum (or balance) K of the amounts of the deposited coins outputted by the addition circuit 25 is applied to a comparison circuit 26 and also to an indication circuit 27 in which the sum (or balance) of the amounts of the deposited coins is indicated. The addition circuit 25 produces an all-zero signal $R_0$ when the sum (or balance) is zero. The all-zero signal $R_0$ is supplied to respective circuits in the coin control unit 10 as a reset signal and also to the vend control unit 11 through the line 13.

Vend prices $SP_1$–$SP_n$ of n kinds of vendible articles are respectively set by vend price set switches 28-1 through 28-n corresponding to the respective articles. Signals representing the prices $SP_1$–$SP_n$ are applied to a memory and delivery circuit 29 in the vend control unit 11. When the all-zero signal $R_0$ supplied through the line 13 is "1", i.e., when the vending machine is in a stand-by mode, the vend prices $SP_1$–$SP_n$ having been set by the switches 28-1 through 28-n are loaded in the memory and delivery circuit 29 and stored therein. When the all-zero signal $R_0$ is "0", the vending machine is in a readout mode and all or a selected one of the vend prices $SP_1$–$SP_n$ is read out under predetermined conditions. The readout signals representing vend prices ($SP_1$–$SP_n$) are applied to the comparison circuit 26 through the line 14.

Conditions for reading the memory and delivery circuit 29 are determined by presence or absence of article selection sigals $S_1'$–$S_n'$. The article selection signals $S_1'$–$S_n'$ initially are all "0" and, at this time, the signals representing the vend prices $SP_1$–$SP_n$ of the respective articles are successively read out on a time-shared basis in accordance with time pusles $Ta_1$–$Ta_n$. When the article has been selected and the vending machine has entered a vend mode, a single article selection signal (one of the signals $S_1'$–$S_n'$) is generated and a signal representing a single vend price corresponding to this selected article (one of the vend prices $SP_1$–$SP_n$) only is read out. The timing pulses $Ta_1$–$Ta_n$ for the time sharing operation are formed on the basis of a clock pulse Ta used for synchronized control of the circuits in the vend control unit 11 (see FIG. 2). This clock pulse Ta has a relatively long pulse period of several milliseconds and the timing pulses $Ta_1$–$Ta_n$ likewise have a pulse width of several milliseconds. In the vend control unit 11, time division timing pusles $Tb_1$–$Tb_n$ (FIG. 2) are also used in correspondence to the timing pulses $Ta_1$–$Ta_n$. The timing pulses $Tb_1$–$Tb_n$ are pulses of a narrow pusle width which build up with a certain length of delay to the pulses $Ta_1$–$Ta_n$.

As the coin has been deposited and the count K of the addition circit 25 has amounted to a value other than 0, the all-zero signal $R_0$ turns to "0" and the memory and delivery circuit 29 is changed to a readout mode. Since the article selection signals $S_1'$–$S_n'$ initially are all "0", the respective vend prices $SP_1$–$SP_n$ are successively read out on a time shared basis from the circuit 29 in accordance with the timing pulses $Ta_1$–$Ta_n$. The comparison circuit 26 compares the vend prices (comprehensively represented by reference characters SP) provided on the line 14 with the output K (the amount of the deposited coin or coins) and, when vending is allowable, it outputs a signal "1" on the line 15. More specifically, a no-change signal NC representing that coins stored to be paid out for change have run out is supplied to the comparison circuit 26 from a change payout control circuit 30. If coins stored to be paid out for change have run out, the comparison circuit 26 outputs a signal "1" only when the count K is equal to the vend price SP (i.e., $K=SP$). If coins for change have not run out, the comparison circuit 26 outputs a signal "1" if the count K is equal to or larger than the vend price SP ($K \geqq SP$). The no-change signal NC is produced when there is no change (or there is no money to be returned) at all in a change storage device (not shown) or the number of coins stored in such change storage device is smaller than a predetermined number. During an operation in which the vend price is subtracted from the amount of the deposited coin or in which change to be paid out is subtracted from the amount of the deposited coin a signal "1" is supplied to an OR gate 115 from a money collection control circuit 73 or the change payout control circuit 30 and comparison in the comparison circuit 26 is inhibited by an output "1" of the OR gate 115.

The output of the comparison circuit 26 is supplied from the line 15 to SD flip-flops 32-1 through 32-n corresponding to the respective articles via AND gates 31-1 through 31-n and OR gates OR 116-1 through 116-n. Each of the AND gates 31-1 through 31-n receives at another input terminal thereof a corresponding one of the time division timing pulses $Tb_1$–$Tb_n$. The AND gates 31-1 through 31-n are enabled in a time sharing manner in accordance with the time shared comparison of the amount K of the deposited coin and the respective vend prices $SP_1$–$SP_n$ in the comparison circuit 26 and all of the SD flip-flops corresponding to vendible articles within a range of the amount K (i.e., one or more of the SD flip-flops 32-1 through 32-n) are set. The above described comparison of the amount of the deposited coin with all of the vend prices $SP_1$–$SP_n$ is hereinafter referred to as "first comparison". Outputs of the flip-flops 32-1 through 32-n are delivered out as vend possible signals $V_1$–$V_n$ via AND gates 35-1 through 35-n. The output of an inverter 36 applied to other inputs of the AND gates 35-1 through 35-n initially is "1".

Each of the SD flip-flops 32-1 through 32-n is driven by the clock pulse Ta (FIG. 2) and outputs the applied signal after delaying it by one bit time (i.e., one period of the clock pulse Ta). The outputs of the flip-flops 32-1 through 32-n are fed back to the inputs thereof via self-holding AND gates 117-1 through 117-n and the OR gates 116-1 through 116-n and self-held in the SD flip-flops 32-1 through 32-n. Upon turning of outputs of NOR gates 34-1 through 34-n applied to other input terminals of the AND gates 117-1 through 117-n to "0", the self-holding of the outputs of the flip-flops 32-1 through 32-n is inhibited and the flip-flops 32-1 through 32-n are reset. The outputs of the NOR gates 34-1 through 34-n are normally "1".

AND gates 33-1 through 33-n are provided for resetting contents of storage of the flip-flops 32-1 through 33-n if the preceding output of the comparison is "1" and the present output of the comparison is "0". Such change in the output of the comparison sometimes occurs when coins for change have run out. Assume, for example, a condition "$K=SP_1$" has been satisfied in the course of throwing coins one after another. A signal "1" then is set in the flip-flop 32-1 which thereby is brought into a vend possible mode. Upon insertion of an additional coin, a condition "$K > SP_1$" is satisfied in a next comparison in respect of the vend price $SP_1$ and a signal "1" is not outputted from the comparison circuit 26 if change is out of stock at that time. This is for prohibiting vending which requires paying out of change. The flip-flops 32-1 has been set to the vend possible mode by the preceding comparison. To cope with the problem, an arrangement is made so that a signal obtained by inverting the comparison output on the line 15, the outputs of the flip-flops 32-1 through 32-n and the timing pulses $Tb_1$–$Tb_n$ are respectively applied to corresponding AND gates 33-1 through 33-n whereby in a case where the preceding comparison output is "1" and the present comparison output is "0", a corresponding one of the AND gates 33-1 through 33-n produces "1". The output signal "1" of the AND gates 33-1 through 33-n is inverted to "0" by NOR gates 34-1 through 34-n thereby disabling AND gates 117-1 through 117-n and resetting the flip-flops 32-1 through 32-n. Consequently, the flip-flops 32-1 through 32-n which have been set to the vend possible mode can be reset immediately upon detection of a state wherein vending is not possible.

Figure 3:
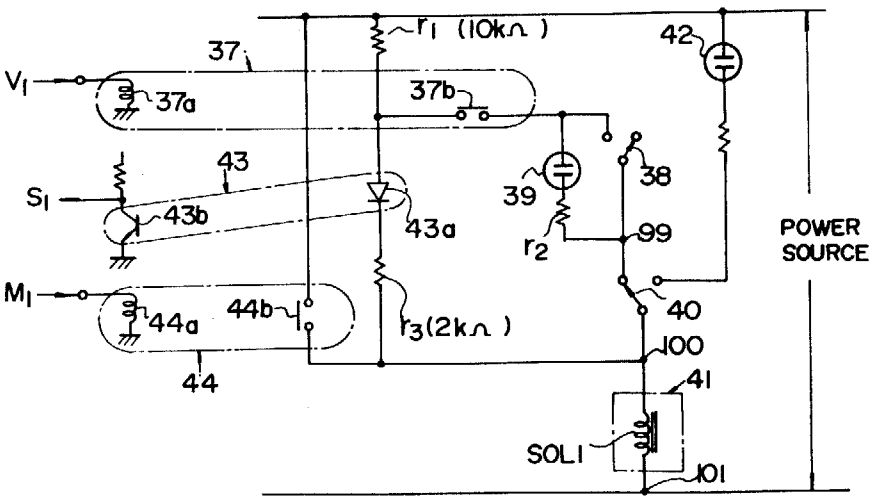
FIG. 3 is a circuit diagram showing an example of a circuit of a vend mechanism controlled by the device shown in FIG. 1.

The vend possible signals $V_1$–$V_n$ are applied to circuits of the respective article selection switches provided in the vend mechanism (not shown) thereby enabling selection of articles by the respective switches. Article selection signals $S_1$–$S_n$ obtained by selective operation of the article selection switches are fed back to the vend control unit 11. An example of the circuit for selecting and dispensing an article is shown in FIG. 3. In FIG. 3, only a circuit corresponding to a single article is illustrated, but it should be noted that the same circuits are provided for the respective articles.

In FIG. 3, a coupler 37 is provided for supplying an electrical power to a circuit of an article selection switch 38, in accordance with the vend possible signal $V_1$. The coupler 37 is constructed in such a manner that if, for example, the vend possible signal $V_1$ is supplied, a relay coil 37*a* is energized and a contact 37*b* is closed. As the contact 37*b* is closed, current flows through a resistor $r_1$, a vend possible lamp 39, a resistor $r_2$, an article out-of-stock detection switch 40 and an article dispensing drive unit 41, thereby lighting the vend possible lamp 39. In a case where the article has run out of stock, the article out-of-stock detection switch 40 is switched to the side of a sold-out indication lamp 42 and selection of the article is prohibited (i.e., the lamp 39 is not lighted). When the vend possible signal $V_1$ is not provided, the contact 37*b* is in an off state and current flows only through a channel of a light-emitting diode 43*a* of a photo coupler 43. Accordingly, the diode 43*a* normally is lighted and an emitter-grounded transistor 43*b* of the photo coupler 43 is in conduction and the article selection signal $S_1$ delivered from the collector of the transistor 43*b* is "0". When the contact 37*b* is ON and the vend possible lamp 39 is lighted, the circuit consisting of the lamp 39 and the resistor $r_2$ is in parallel with the circuit consisting of the diode 43*a* and the resistor $r_3$ and a voltage is produced due to the resistor $r_2$ so that the diode 43*a* is not turned off but continues to emit light.

When a purchaser switches on the article selection switch 38 after confirming that the vend possible lamp 39 is lighted, the circuit of the lamp 39 and the resistor $r_2$ is short-circuited by the switch 38. This causes the light-emitting diode 43*a* and the transistor 43*b* to be turned off and the article selection signal $S_1$ to rise to "1". The article selection signal $S_1$ (and other article selection signals $S_2$–$S_n$ also) is produced in the above described manner and supplied to the vend control unit 11 (FIG. 1). The resistor $r_1$ which is connected in series to the parallel circuit of the diode 43*a*, the vend possible lamp 39, the article selection switch 38 is of a resistance value of about 10 kΩ which is much larger than a total resistance of the circuit of the article selection switch 38 and the article dispensing drive unit 41. Besides, impedance of the drive unit 41 is of a small value of about 10–100Ω. Accordingly, if the diode 43*a* is in conduction in the stand-by mode or the circuit comprising the article selection switch 38 to which the vend possible signal $V_1$ has been supplied and the lamp 39 is in conduction, voltage applied to the drive unit 41 is too small to drive the drive unit 41. A state in which selection of articles by specific article selection switches only is possible in accordance with the vend possible signals $V_1$–$V_n$ (i.e., a state prior to actual dispensing of a selected article) is hereinafter referred to as "vending stand-by mode" and is distinguished from a normal stand-by mode (a state before deposition of a coin). As will be described later, when a vend drive signal $M_1$ is applied from the vend control unit 11 to a coupler 44, a contact 44*b* is closed to supply an electrical power directly to the drive unit 41 to drive the same. Although a solenoid coil $SOL_1$ is used for the drive unit 41 shown in FIG. 4, a motor be used instead of the solenoid coil.

Reverting to FIG. 1, the article selection signals $S_1$–$S_n$ are applied through AND gates 45-1 through 45-n, OR gates 46-1 through 46-n and 47-1 through 47-n to SD flips 48-1 through 48-n and stored therein. The AND gates 45-1 through 45-n function to cause a single article selection signal (one of $S_1$–$S_n$) only to be stored in the SD flip-flops 48-1 through 48-n receiving the time division timing pulses $Ta_1'$–$Ta_n'$ and an output of a NOR gate 49 through which all outputs of the SD flip-flops 48-1 through 48-n are combined together. The outputs of the SD flip-flops 48-1 through 48-n are supplied to the memory and delivery circuit 29 as article seleciton signals $S_1'$–$S_n'$. The time sharing clock pulses $Ta_1'$–$Ta_n'$ are pulses of the same width and period as the time sharing clock pulses $Ta_1$–$Ta_n$ but appear one bit time in advance of the clock pulses $Ta_1$–$Ta_n$, for the signal is delayed by one bit time through the SD flip-flops 48-1 through 48-n. Accordingly, the pulse $Ta_1'$ appears synchronously with $Ta_n$, the pulse $Ta_2'$ appears synchronously with $Ta_1$, . . . and the pulse $Ta_n'$ appears synchronously with $Ta_{(n-1)}$.

Since the AND gates 45-1 through 45-n are enabled in a time sharing manner by the pulse $Ta_1'$–$Ta_n'$, only one signal among the article selection signals $S_1$–$S_n$ is selected at one time slot even if a plurality of article seleciton signals $S_1$–$S_n$ are simultaneously generated by simultaneous depression of a plurality of article seleciton switches 38. If, for example, the signals $S_1$ and $S_n$ have built up at the timing of the pulse $Ta_1'$, the signal $S_1$ only is selected by the AND gate 45-1 and the signal Sn is inhibited by the AND gate 45-n. Then as a signal "1" is outputted from the SD flip-flop 48-1 in which the signal $S_1$ has been loaded at the timing of the pulse $Ta_2'$, i.e., the pulse $Ta_1$, the ouptut of the NOR gate 49 falls to "0" thereby disabling all of the AND gates 45-1 through 45-n. Accordingly, upon arrival of the timing of the pulse $Ta_n'$, the signal $S_n$ is inhibited by the AND gate 45-n. Thus, the single article selection signal $S_1$ is selected. The output of the SD flip-flops 48-1 storing the selected signal $S_1$ is fed back to an AND gate 50-1. The AND gate 50-1 receives at another input thereof the article selection signal $S_1$. The output of the AND gate 50-1 is fed back to the SD flip-flip 48-1 through the OR gates 46-1 and 47-1. The selected article selection signal $S_1$ therefore is held by the SD flip-flop 48-1 so long as the signal $S_1$ is present. It should be noted that the clock pulse Ta and the time division timing pulses $Ta_1'$–$Ta_n'$ are of such a high rate compared with the switch depressing operation by a human finger that the signal $S_1$ circulates several times within the SD flip-flop 48-1 within the matter of about one second during which the signal $S_1$ is produced by depression of the switch.

On the other hand, all of the article selection signals $S_1$–$S_n$ are applied to an OR gate 51. Upon receipt of any one of the signals $S_1$–$S_n$, the output of the OR gate 51 rises to "1" which is applied to a rise detection circuit 52. The rise detection circuit 52 detects rise of the signals $S_1$–$S_n$ and thereupon generates one shot of pulse having a predetermined pulse width. The rise detection pulse from the circuit 52 is supplied through an OR gate 53 to the NOR gates 34-1 through 34-n, thereby disabling all of the self-holing AND gaes 117-1 through 117-n while resetting the flip-flops 32-1 through 32-n. Consequently, the vend possible signals $V_1$–$V_n$ having been stored in the flip-flops 32-1 through 32-n as a result of the above described "first comparison" are all cancelled.

Among the article selection signals $S_1'$–$S_n'$ outputted from the SD flip-flops 48-1 through 48-n, only a single signal corresponding to the selected article is "1" and the rest of the signals $S_1'$–$S_n'$ are all "0". These signals $S_1'$–$S_n'$ are supplied to the memory and delivery circuit 29. The reading condition of the circuit 29 changes when one of the signals $S_1'$–$S_n'$ rises to "1" and the single vend price signal (one of the singals $SP_1$–$SP_n$) corresponding to the selected article only is read out. The read out signal is applied to the comparison circuit 26 through the line 14. The comparison circuit 26 compares the amount (or balance) of the deposited coin with the vend price of the selected article (one of $SP_1$–$SP_n$) and produces a signal "1" on the line 15 if the vending is possible. This comparison is hereinafter referred to as "second comparison". The signal "1" on the line 15 is stored in one of the flip-flops 32-1 through 32-n corresponding to the selected article in accordance with the timing pulses (one of the timing pulses $Tb_1$–$Tb_n$) corresponding to the article.

For reading out a single vend price signal only from the memory and delivery circuit 29, one of the following two methods may be employed. According to one of these methods, generation of the time division timing pulses $Ta_1$–$Ta_n$ and $Tb_1$–$Tb_n$ is fixed when one of the article selection signals $S_1'$–$S_n'$ has risen to "1" so that a single timing pulse (one of the pulses $Ta_1$–$Ta_n$ and one of the pulses $Tb_1$–$Tb_n$) is sustained and the vend price signal for the selected article provided on the line 14 thereby is sustained. According to the other method, one of the timing pulses $Ta_1$–$Ta_n$ corresponding to the generated single selected article signal (one of $S_1'$–$S_n'$) only is made valid and the rest of the timing pulses are nullified, and the vend price signal for the selected article only is intermittently provided on the line 14 at the timing of the validated timing pulse. An example of a circuit embodying the former method is shown in FIG. 4 and an example of a circuit embodying the latter method is shown in FIG. 5.

Figure 2:
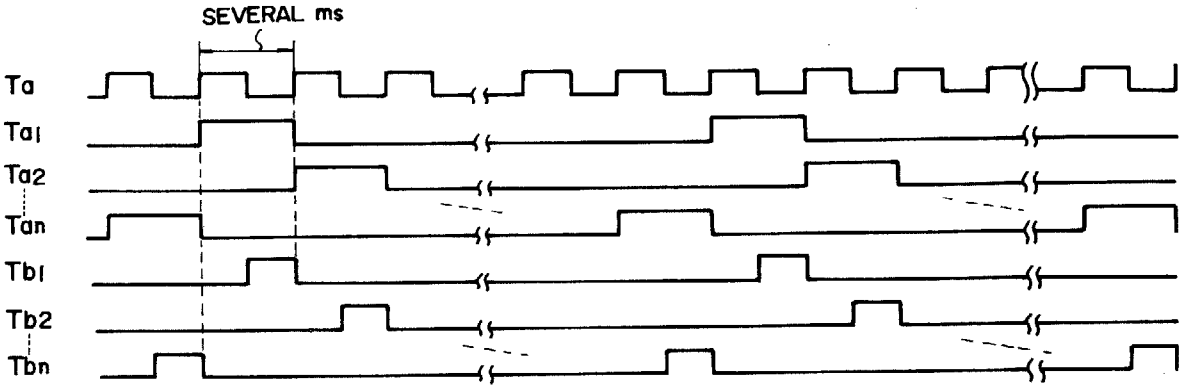
FIG. 2 is a time chart showing examples of a clock pulse and a time division timing pulse employed in a vend control unit shown in FIG. 1.
Figure 4:
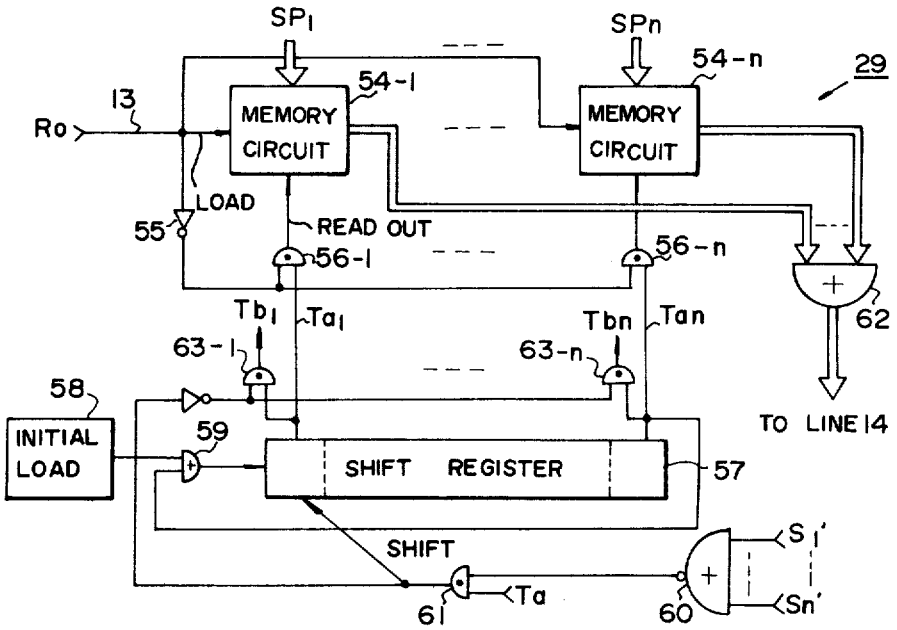
FIG. 4 is a block diagram showing an example of a memory and delivery circuit shown in FIG. 1.

Referring to FIG. 4, when the all-zero signal $R_0$ is "1", i.e. in the standby mode, the vend prices $SP_1$–$SP_n$ are loaded into respective memory circuits 54-1 through 54-n. Upon deposition of a coin and resulting turning of the all-zero signal to "0", the output of an inverter 55 rises to "1" thereby enabling AND gates 56-1 through 56-n. An n-stage shift register 57 has a signal "1" loaded by an initial load circuit 58 at the time of switching on of an electrical power and holds this signal "1" in a single one of the n-stages thereof. When the article selection signals $S_1'$–$S_n'$ are all "0", the output of a NOR gate 60 is "1" so that the clock pulse Ta is applied to the shift register 57 as a shift clock pulse. This causes the single signal "1" to be successively shifted to a next stage of the shift register 57 and circulate therein through an OR gate 59. Accordingly, the time division timing pulses $Ta_1$–$Ta_n$ as shown in FIG. 2 are circulatingly generated from the respective stages of the shift register 57 and applied to the AND gates 56-1 through 56-n. The vend price signals $SP_1$–$SP_n$ are read from the memory circuits 54-1 through 54-n in accordance with the time division timing pulses $Ta_1$–$Ta_n$ provided through the AND gates 56-1 through 56-n. The read out vend price signals $SP_1$–$SP_n$ are provided on the line 14 on a time shared basis through an OR combination cicruit 62. Further, the time division timing pulses $Tb_1$–$Tb_n$ are produced from AND gates 63-1 through 63-n in response to the pulses $Ta_1$–$Ta_n$ and the output (TA) of the AND gate 61. Upon rising of one of the article selection signals $S_1'$–$S_n'$ to "1" the output of the NOR gate 60 is turned to "0", resulting in prohibition of passing of the clock pulse Ta through the AND gate 61 and stopping of the shifting operation of the shift register 57. Consequently, one of the timing pulses $Ta_1$–$Ta_n$ corresponding to the single selected article is sustained at the "1" level and generation of the vend price signal corresponding to the article thereby is sustained.

Figure 5:
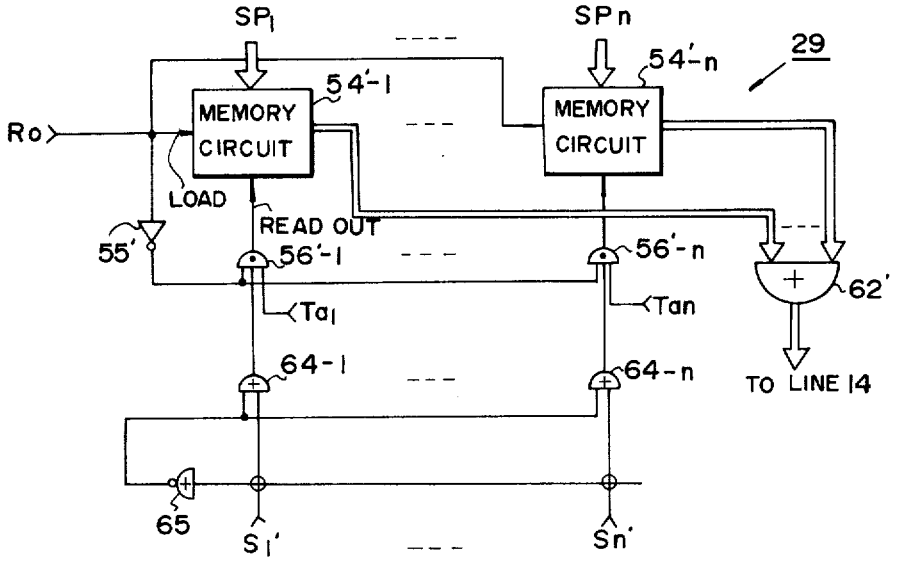
FIG. 5 is a block diagram showing another example of the memory and delivery circuit.

Referring now to FIG. 5, circuits designated by reference characters 54'-1 through 54'-n, 55', 56'-1 through 56'-n and 62' function in the same manner as the circuit 54-1 through 54-n, 55, 56-1 through 56-n and 62 shown in FIG. 4. The AND gates 56'-1 through 56'-n, however, have three inputs receiving the output of an inverter 55', the time division timing pulses $Ta_1$–$Ta_n$ and the outputs of OR gates 64-1 through 64-n. The article selection signals $S_1'$–$S_n'$ are applied to the OR gates 64-1 through 64-n and also to a NOR gate 65. When the article selection signals $S_1'$–$S_n'$ are not generated, AND gates 56'-1 through 56'-n are enabled through the OR gates 64-1 through 64-n whereby the respective vend prices $SP_1$–$SP_n$ are successively read out in accordance with the pulses $Ta_1$–$Ta_n$. Upon rising of one of the article selection signals $S_1'$–$S_n'$ to "1", the output of the NOR gate 65 is turned to "0" and one of the OR gates 64-1 through 64-n corresponding to the built up article selection signal only produces a signal "1". Accordingly, a single vend price signal corresponding to the selected article only is intermittently read out at the timing of a corresponding one of the pulses $Ta_1$–$Ta_n$.

In the circuit shown in FIG. 1, the AND gates 66-1 through 66-n receive the outputs of the flip-flops 32-1 through 32-n and the outputs $S_1'$–$S_n'$ of the SD flip-flops 48-1 through 48-n. If, accordingly, the selected article has been found vendible as a result of the second comparison, a signal "1" is outputted from one of the AND gates 66-1 through 66-n corresponding to the selected article. The outputs of the AND gates 66-1 through 66-n are applied to AND gates 67-1 through 67-n and also to an OR gate 68. An output "1" of the OR gate 68 is delayed by a timer 69 by a preset time length $TM_1$ and thereafter is provided on the line 16 as a vend start signal VS. The output VS of the timer 69 is applied commonly to self-holding AND gates 93-1 through 93-n of flip-flops 48-1 through 48-n provided for storing the article selection signals and used to hold the storage of the single article selection signal (one of $S_1'$–$S_n'$) in one of the flip-flops 48-1 through 48-n. The output VS of the timer 69 is inverted by the inverter 36 and thereby disables the AND gates 35-1 through 35-n and inhibits the vend possible signals $V_1$–$V_n$. To other inputs of the AND gates 93-1 through 93-n are applied the outputs of the SD flip-flops 48-1 through 48-n, outputs $V_1'$–$V_n'$ of the SD flip-flops 32-1 through 32-n storing the vend possible signals and also a reset signal from an inverter 118. The output of the inverter 118 normally is "1" and is turned to "0" in the reset mode. Thus, upon turning of the single vend possible signal among the signals $V_1'$–$V_n'$ to "1" by the second comparison and resulting generation of the vend start signal VS, the signal (one of $S_1'$–$S_n'$) stored in one of the SD flip-flops 48-1 through 48-n corresponding to the single vend possible signal is self-held.

The vend start signal VS outputted by the timer 69 is also applied through the line 16 to a timer 70 of the coin control unit 10 and a load control input of a register 71. The register 71 receives at its data input the signal representing the vend price of the selected article through the line 14 so that the vend pirce signal of the selected article is loaded in the register 71 in response to the output of the timer 69. The delay time $TM_1$ of the timer 69 which is set at about 100 ms, for instance, is provided for awaiting arrival of a state in which the vend price signal provided from the vend control unit 11 to the coin control unit 10 through the line 14 is completely stabilized so that the second comparison in the comparison circuit 26 is completely stabilized, and for loading a stable article selection signal in the register 71 and also for self-holding of the signals $S_1'$–$S_n'$ upon stabilization of the article selection signals $S_1$–$S_n$.

The vend start signal VS is further delayed by the timer 70. The output of the timer 70 is applied to a readout control input of the register 71 and also to the money collection control circuit 73 for bringing the circuit 73 into a money collection mode. The vend price signal loaded in the register 71 in response to the vend start signal VS is read therefrom in response to the output of the timer 70 and thereafter is applied to the money collection control circuit 73. Upon receipt of a signal "1" from the timer 70 through a line 74, the money collection control circuit 73 subtracts the vend price stored in the register 71 from the counts of the counters 21–23 in which the amount of the deposited coins is computed. This subtraction is made by converting the amount of the deposited coins equivalent to the vend price to a sum of lower denomination coins, utilizing counts of respective denominations stored in the respective counters. More specifically, a count $K_{10}$ of the counter 23 for the 10-yen coin which is the smallest denomination coin is compared with the vend price SP provided by the register 71. If the count $K_{10}$ is larger than or equal to the vend price SP, i.e., $K_{10} \geqq SP$, a signal "1" is supplied to the OR gate 24 through a line 75 to bring the counter 23 into a subtraction mode, pulses corresponding to the vend price SP are provided on a 10-yen line $L_1$, and the pulses on the line $L_1$ are applied from the OR gate 20 to the counter 23 for subtracting the vend price SP. If the count $K_{10}$ is smaller than the vend price SP, i.e., $K_{10} < SP$, the count of the counter 22 for the 50-yen coin is transfered to the 10-yen coin counter 23, that is, 50 yen is subtracted from the amount of coins deposited in the 50-yen counter 22 and this 50 yen is added to the count of the counter 23, this operation being repeated until the condition $K_{10} \geqq SP$ is satisfied. If the subtraction from the count of the 50-yen counter 22 is not sufficient, the count of the 100-yen counter 21 is transferred to the count of the 10-yen counter 23. Upon satisfaction of the condition $K_{10} \geqq SP$ by transferring the amount of the 100-yen or 50-yen coins to the count of the 10-yen counter, the vend price SP is subtracted from the count of the counter 23. The above described operation enables a balance to be left in counters for coins of larger denominations among the counters 21–23 so that the coins of larger denominations can be paid out as change. Alternatively stated, coins of a small denomination which are more frequently used for change than coins of large denominations can be stored in the coin box to a maximum extent possible whereby shortage of change can be prevented.

On the other hand, the output of the timer 70 is fed back to the vend control unit 11 through the line 17 to enable AND gates 67-1 through 67-n and cause the outputs of the AND gates 66-1 through 66-n to be stored in memory circuits 72-1 through 72-n.

In the foregoing manner, a signal "1" is stored in a single memory circuit (one of the circuits 72-1 through 72-n) corresponding to the selected article and the output of this single memory circuit is applied to the article dispensing drive unit as vend drive signals $M_1$–$M_n$. If, for example, the vend drive signal $M_1$ rises to "1" as shown in FIG. 3, the relay coil **44*a* of the coupler 44 is energized to close the contact 44*b* thereby causing the drive unit 41 to be driven to dispense a piece of the selected article. The delay time $TM_2$ of the timer 70 is set, for example, at about 300 ms, taking into account time required for completely loading the vend price signal into the register 71**.

When the vend drive signal has been outputted from one of the memory circuits 72-1 through 72-n, an OR gate 76 to which all of the outputs of the memory circuits 72-1 through 72-n are applied produces an output "1" which output in turn is applied to timers 77 and 78. The timer 77 is provided for ensuring a sufficient operation time of a solenoid in case the solenoid is employed as the article dispensing drive unit 41. Delay time $TM_3$ of the timer 77 is set, for example, at about 500 ms. The output of the timer 77 is applied to reset inputs of the memory circuits 72-1 through 72-n through a switching gate 79. The switching gate 79 selects the output of the timer 77 in case a solenoid is used as the article dispensing drive unit 41 whereas it selects the output of an OR gate 80 in case a motor is used as the drive unit 41. The switching gate 79 can be constructed to fixedly select either one of these outputs once the construction of the drive unit 41 has been determined. If, accordingly, the solenoid is used as the drive unit 41, the single memory circuit (one of the memory circuits 72-1 through 72-n) is reset and the vend drive signal (one of $M_1$–$M_n$) falls to a "0" level upon lapse of the time $TM_3$ of the timer 77 counting from the rise of the vend drive signal.

In a case where a solenoid is used as the drive unit 41, the operation time thereof is completely secured by the timer 77, whereas in a case where a motor is used, a time interval until a carrier switch of the motor is stabilized at a switching time is secured by the timer 81. In case the motor is used as the drive unit 41, the portion of a solenoid $SOL_1$ of the drive unit 41 shown in FIG. 3 is replaced by a motor $MT_1$ and a carrier switch $CSW_1$ shown in FIG. 6. Carrier switches $CSW_1$, $CSW_2$ . . . $CSW_n$ corresponding to respective articles are connected in series between a coupler 82 for a CIN signal and a coupler 83 for a COT signal. The coupler 82 and 83 are provided, like the couplers 37, 43 and 44 shown in FIG. 3, for signal conversion between the motor power source circuit and the vend control unit 11. The CIN signal is supplied from an AND gate 84 and the OCT signal is supplied to an AND gate 85.

Figure 6:
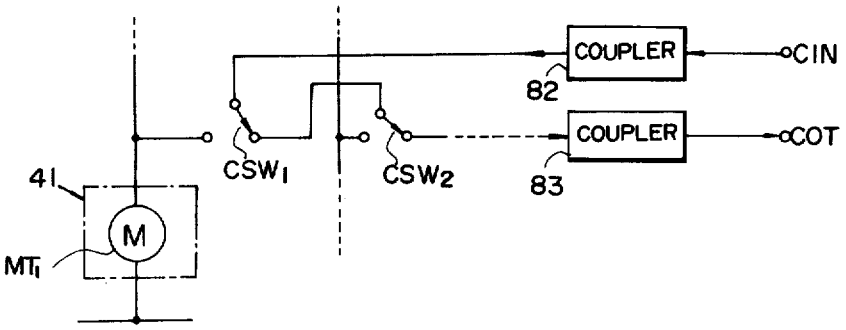
FIG. 6 is a circuit diagram showing an example in which a motor is employed as an article dispensing drive unit.
Figure 7:
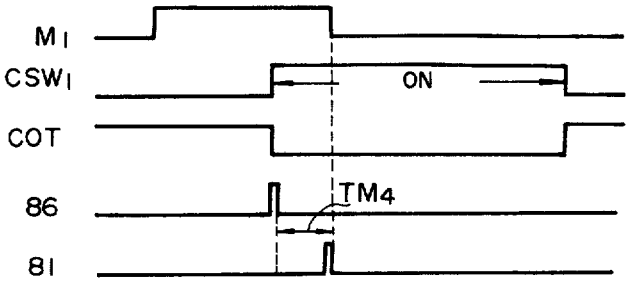
FIG. 7 is a time chart showing an example of a manner for driving the motor.

Referring to FIGS. 1, 3, 6 and 7, driving of the motor $MT_1$ of the drive unit 41 will now be described. Upon generation of the vend drive signal $M_1$ from the memory circuit 72-1, the contact **44*b* (FIG. 3) is closed as previously described and current flows through the drive unit 41 to drive the motor $MT_1$ (FIG. 6). As the carrier switch $SCW_1$ is subsequently turned on (FIG. 7), the motor $MT_1$ is driven by a power applied from the coupler 82 through the carrier switch $CSW_1$ and AND gate 84 (FIG. 1) receives a signal obtained by inverting the all-zero signal $R_0$ ("1" in the vending mode) and a signal obtained by inverting the output of the timer 78 (normally "1") so that it normally produces a signal "1". Therefore, the CIN signal normally is "1" and the power is always applied to the carrier switch $CSW_1$ from the coupler 82. As the carrier switch $CSW_1$ is switched on (i.e., switched from the illustrated position), an input signal to the coupler 83 is disconnected. Accordingly, the COT signal supplied from the coupler 83 is "1" if the carrier switch ($CSW_1$) is off and falls to "0" if the carrier switch is on. The fall of the COT signal to "0" causes the output of the AND gate 85 shown in FIG. 1 to fall to "0" and a fall detection circuit 86 produces a fall detection pulse (FIG. 7). The output pulse of the fall detection circuit 86 is delayed by a timer 81 (see FIG. 7) and thereafter is supplied through an OR gate 80 and the switching gate 79 to the memory circuits 72-1 through 72-n to reset the memory circuits. The vend drive signals $M_1$ -$M_n$ therefore are cancelled by the output of the timer 81. The motor $MT_1$ however is continuously driven by the power supplied from the carrier switch $CSW_1$. The delay timer $TM_4$ of the timer 81** is set at a time length required for absorbing chattering which occurs in switching of the carrier switch $CSW_1$ and thereby reaching a stable ON state (e.g. about 100 ms). When one piece of the articles has been dispensed, the carrier switch $CSW_1$ is turned off (i.e., returned to the illustrated position) and the COT signal rises to "1".

The output of the switching gate 79 (i.e., the output of the timer 77 or 81) is used as an all-reset signal AR for resetting all information stored in the vend control unit 11. The all-reset signal AR outputted by the switching gate 79 is applied through the OR gate 53 to the NOR gates 34-1 through 34-n thereby disabling the self-holding AND gates 117-1 through 117-n and resetting the SD flip-flops 32-1 through 32-n storing the vend possible signal. The all-reset signal AR is also inverted by the inverter 118 and thereafter is applied to the self-holding AND gates 93-1 through 93-n to reset the SD flip-flop 48-1 through 48-n storing the article selection signal.

The timer 78 is provided as protecting means to cope with an abnormal state of the carrier switches $CSW_1$, $CSW_2$, etc. Delay time $TM_5$ of the timer 78 is of a relatively long time length (e.g. 1 second). When the carrier switches are operating in a normal state, the COT signal once falls and then rises again before a signal "1" which has been applied to the timer 78 from the OR gate 76 is outputted from the timer 78 after being delayed by the delay time $TM_5$. In response to this rise of the COT signal a rise detection pulse is outputted by a rise detection circuit 87 and the timer 78 is reset by this rise detection pulse. Accordingly, the output of the timer 78 is always "0". If however, the carrier switches $CSW_1$, $CSW_2$ . . . are not turned on despite generation of the vend drive signals $M_1$-$M_n$, the COT signal does not rise and the rise detection circuit 87 therefore does not produce the rise detection pulse so that the timer 78 continues the delaying operation without being reset. Upon lapse of the delay time $TM_5$ of the timer 78 in this state, the timer 78 outputs a signal "1" and the memory circuit 72-1 through 72-n are reset through the OR gate 80 thereby cancelling the vend drive signals $M_1$-$M_n$. The AND gate 87 is disabled by a signal obtained by inverting the coutput of the timer 78 and the CIN signal thereby is turned to "0". This causes cutting of the power to the motor $TM_1$. If the carrier switches $CSW_1$, $CSW_2$ . . . are once turned on but are not turned off for an unduly long time (i.e., the COT signal does not rise), the rise detection signal is not produced from the rise detection circuit 87 and the timer 78 therefore is not reset. Accordingly, the AND gate 84 is disabled upon lapse of the delay time of the timer 78 and the CIN signal is turned to "0" resulting in cutting of the power to the motor $MT_1$.

By repeatedly depressing the article selection switch, vending can be continuously made several times within the amount of the deposited coins. The money collection control circuit 73 is operated each time the vending is made for subtracting the vend price from the amount of the deposited coins stored in the counters 21-23. When the purchasing of the article is to be ended, a clear switch 88 is depressed to cause a clear signal to be stored in a memory circuit 89. The clear signal stored in the memory circuit 89 is applied to a timer 91 through an AND gate 90. The AND gate 90 receives at another input thereof a signal produced by inverting the output of the timer 70 by an inverter 92 so that a clear mode will not be brought about immediately even if the clear switch 88 is depressed when the money collection control circuit 73 is in operation. The output of the timer 91 is applied to the change payout control circuit 30 as a change payout command signal. The change payout control circuit 30 effects, upon receipt of the change payout command signal from the timer 91, a control operation for paying out, as the change balances of respective denominations left in the respective counters 21-23 in such denominations. Simultaneously, a signal "1" is supplied through the OR gate 24 to the counters 21-23 to bring about the subtraction mode and pulses corresponding to the amount having been paid out as the change are supplied to the counters 21-23 through the OR gates 18, 19 and 20 to subtract the amount of change from the counters 21-23. In this manner, the change is paid out until the contents of the counters 21-23 are reduced to zero. Upon reaching of the contents of the counters 21-23 to zero, the all-zero signal $R_0$ is generated and the memory circuit 89 thereby is reset. The timer 91 is provided for setting a waiting time $TM_6$ so that acceptance of a thrown-in coin into a coin tube will be ensured in a case where the clear switch 88 is depressed immediately after the coin has been thrown in.

Figure 8:
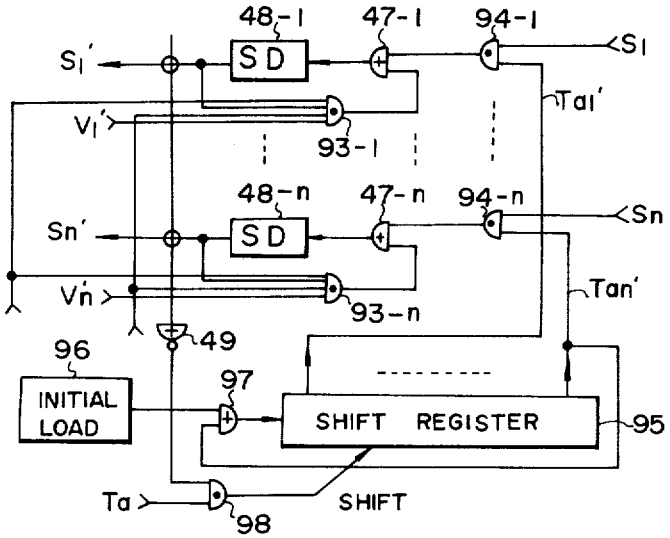
FIG. 8 is a block diagram showing modified example of a circuit for selecting a single article selection signal shown in FIG. 1.

The circuits 45-1 through 50-n and 93-1 through 93-n (FIG. 1) for selectively storing a single one of the article selection signals $S_1$–$S_n$ may be composed as shown in FIG. 8. In FIG. 8, an n-stage shift register 95 receives a single signal "1" from an initial load circuit 96 when the power source is switched on. This single signal "1" circulates within the shift register 95 through an OR gate 97. The clock pulse Ta is applied to the shift register 95 from an AND gate 98 as a shifting clock pulse. Timing pulses $Ta_1'$–$Ta_n'$ used for time sharing operations outputted from respective stages of the shift register 95 are applied to the AND gates 94-1 through 94-n. The AND gates 94-1 through 94-n receive at other input thereof are article selection signals $S_1$–$S_n$. If, for example, the article selection signal $S_1$ is stored in the SD flip-flop 48-1 at the timing of the pulse $Ta_1'$, the output of the NOR gate 49 falls to "0" and the clock pulse Ta is inhibited. Accordingly, shifting of the shift register 95 is stopped and the pulse $Ta_1'$ is fixedly produced. In this manner, even if a plurality of the article selection signals $S_1$–$S_n$ are generated, only one of them is stored in one of the SD flip-flops 48-1 through 48-n.

In the circuit shown in FIG. 3, the resistor $r_3$ which is connected in series to the light-emitting diode 43*a* and has a relatively large resistance value (e.g. 2kΩ) is provided for preventing an abnormal operation of the diode 43*a*. The circuit elements of FIG. 3 are interconnected by means of connectors which are disposed at respective junctions 99, 100, 101 etc. If malfunction occurs in these connectors, impedance of the circuit increases and, but for the resistor $r_3$, the light-emitting diode 43*a* would readily be brought out of conduction. By providing the resistor $r_3$ of a relatively large resistance value on the cathode side of the diode 43*a*, the diode 43*a* is not brought out of conduction so easily by a minor malfunction of the connectors so that the abnormal operation of the diode 43*a* can be prevented.

Figure 9:
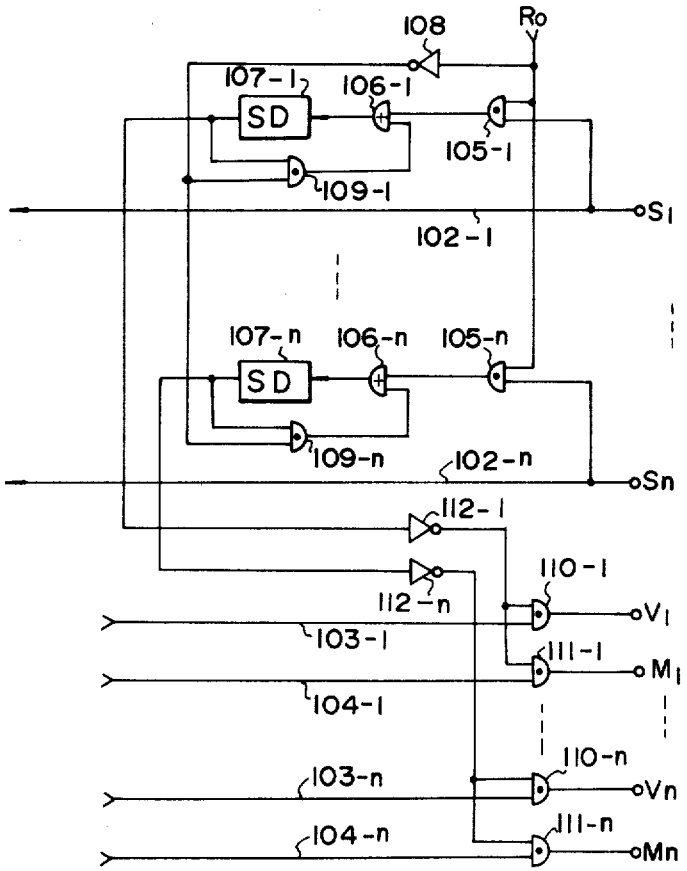
FIG. 9 is a circuit diagram showing an example of a malfunction detection circuit for coping with an abnormal occurrence of an article selection signal.

For ensuring prevention of the abnormal operation of the light-emitting diode 43*a*, a malfunction detection circuit as shown in FIG. 9 may be provided in connection with input lines 102-1 through 102-n for the article selection signals $S_1$–$S_n$, output lines 103-1 through 103-n for the vend possible signals $V_1$–$V_n$ and output lines 104-1 through 104-n for the vend drive signals $M_1$–$M_n$ shown in FIG. 1. In FIG. 9, AND gates 105-1 through 105-n receive the article selection signals $S_1$–$S_n$ provided on the lines 102-1 through 102-n and the all-zero signal $R_0$. If the coil of the drive unit 41 (FIG. 3) is broken or the connector at the junction 100 or 101 is disconnected or insufficiently connected, the light-emitting diode 43*a* remains in an off state and the article selection signal $S_1$ thereby holds a "1" level. If such abnormal operation of the photo diode 43*a* takes place, one of AND gates 105-1 through 105-n corresponding to one of the article selection signals $S_1$–$S_n$ which is abnormally produced is enabled in the stand-by mode (i.e., when the all-zero signal $R_0$ is "1") and a signal "1" is loaded into one of SD flip-flops 107-1 through 107-n via one of OR gates 106-1 through 106-n. As the vending machine is brought into the vend mode by deposition of a coin, the all-zero signal $R_0$ falls to "0" and a signal "1" is supplied from an inverter 108 to AND gates 109-1 through 109-n so that the signal "1" having been loaded in one of the SD flip-flops 107-1 through 107-n is self-held therein. The output "1" of the SD flip-flops 107-1 through 107-n indicates the abnormal generation of the article selection signals $S_1$–$S_n$.

AND gates 110-1 through 110-n are provided in the output lines 103-1 through 103-n of the vend possible signals $V_1$–$V_n$ and AND gates 111-1 through 111-n are provided on the output lines 104-1 through 104-n of the vend drive signals $M_1$–$M_n$. The AND gates 110-1, 111-1 through 110-n, 111-n receive at other inputs thereof outputs of respective corresponding SD flip-flops 107-1 through 107-n after they are inverted by inverters 112-1 through 112-n. Accordingly, corresponding one of the AND gates 110-1, 111-1 through 110-n, 111-n for one of the article selection signals $S_1$–$S_n$ which has been abnormally generated are disabled whereby generation of the corresponding vend possible signal and vend drive signal is inhibited.

Figure 10:
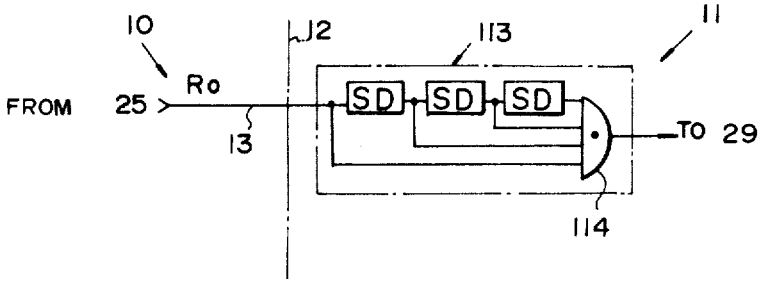
FIG. 10 is a circuit diagram showing an example of a noise cancellation circuit provided in a signal transmission line between a coin control unit and a vend control unit.

If the coin control unit 10 and the vend control unit 11 are built up on separate bases in the circuit shown in FIG. 1, wiring for the lines 13–17 are extended and, accordingly, there is likelihood of occurrence of noise which is mixed in signals supplied on these lines. For coping with this problem, a proper noise cancellation circuit may be provided on the receiving side of the lines 13–17. An example of the noise cancellation circuit is shown in FIG. 10 with respect to the line 13. A noise cancellation circuit 113 consisting of serially connected SD flip-flops and an AND gate 114 to which the output on the line 13 and the respective outputs of these SD flip-flops are applied is provided on the side of the vend control unit 11 receiving the signal $R_0$ on the line 13. THe output of the noise cancellation circuit 113 is applied to the memory and delivery circuit 29. The AND gate 114 is not enabled even if noise is mixed in a signal supplied on the line 13 so that a signal is not supplied to the memory and delivery circuit 29 and an erroneous operation of the circuit 29 can be prevented.

In the above described embodiment, there is no interrelation between the vend possible signals $V_1$–$V_n$ and the article selection signals $S_1$–$S_n$ in the vend control unit 11 in FIG. 1, but selection of the article is made on the basis of the vend possible signals ($V_1$–$V_n$) produced in the circuit of the article selection switch 38 provided on the vend mechanism side shown in FIG. 3 in which the contact 37*b* is directly connected to the switch 38. Alternatively, the circuit of FIG. 3 may be simplified so that the article selection signals $S_1$–$S_n$ will be generated unconditionally upon depression of the article selection switches regardless of presence or absence of the vend possible signals $V_1$–$V_n$. Such unconditional generation of the article selection signals $S_1$–$S_n$ does not cause any inconvenience, for it is checked by the "second comparison" whether the selected articles are vendible or not. If collation of the article selection signals $S_1$–$S_n$ with the vend possible signals $V_1$–$V_n$ is desired in a case where the circuit shown in FIG. 3 is simplified by adopting an arrangement in which the article selection signals $S_1$–$S_n$ are unconditionally generated, AND gates may be provided in the lines 102-1 through 102-n in FIG. 1, which AND gates receive the signals $S_1$–$S_n$ and $V_1$–$V_n$ and select the signals $S_1$–$S_n$ on condition that the signals $V_1$–$V_n$ have been generated.

Modified examples of the vend control unit 11 shown in FIG. 1 are illustrated in FIGS. 11–15. Throughout FIGS. 11–15, circuits designated by the same reference characters as those used in FIG. 1 perform the same functions as the circuits in FIG. 1 so that detailed description thereof will be omitted. In FIGS. 11–15 illustration of the coin control unit 10 is omitted but it should be understood that each of the vend control units 11 shown in FIGS. 11–15, like the vend control unit 11 in FIG. 1, is connected to the coin control unit 10 of the same type as shown in FIG. 1 through lines 13–17.

Figure 11:
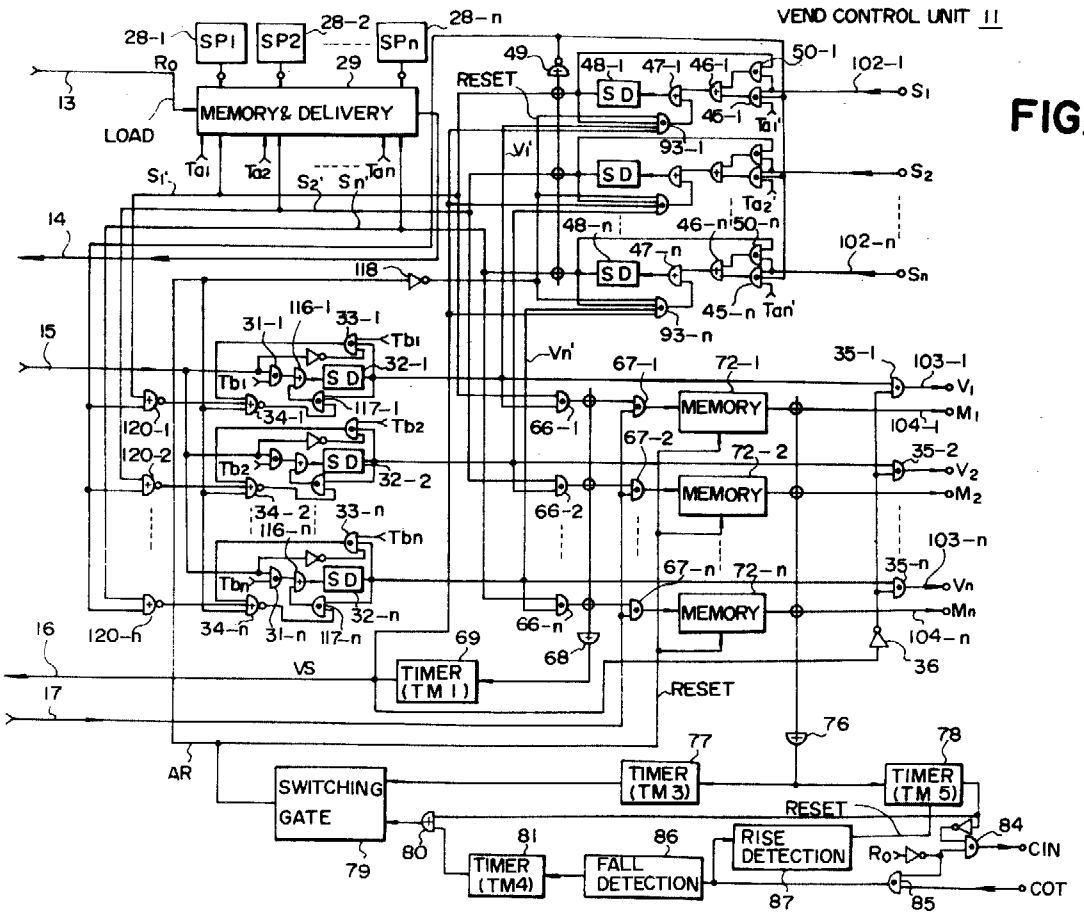
FIGS. 11 through 15 are circuit diagrams showing modifications of the vend control unit shown in FIG. 1.

As was previously described, the vend control unit 11 shown in FIG. 1 is so arranged that after generation of the article selection signals $S_1$–$S_n$by manipulation of the article selection switches, the SD flip-flops 32-1 through 32-n are reset by the output of the rise detection circuit 52 to cancel all of the vend possible signals $V_1$–$V_n$. In the vend control unit 11 shown in FIGS. 11, the vend possible signals ($V_1$–$V_n$) are cancelled except a single vend possible signal corresponding to the selected article. The vend control unit 11 shown in FIG. 11 is different in construction from the vend control unit 11 shown in FIG. 1 in that the OR gate 51, the rise detection 11 shown in FIG. 1 in that the OR gate 51, the rise detection circuit 52 and the OR gate 53 shown in FIG. 1 are excluded from the circuit shown in FIG. 11 and that each of NOR gates 34-1 through 34-n for clearing the contents stored in the SD flip-flops 32-1 through 32-n is composed of a three-input type circuit in FIG. 11 and outputs of NOR gates 120-1 through 120-n provided newly in FIG. 11 are applied to the NOR gates 34-1 through 34-n. The NOR gates 120-1 through 120-n receive at one input thereof the output of the NOR gate 49 and at another input thereof the article selection signals $S_1'$–$S_n'$ outputted by the SD flip-flops 48-1 through 48-n.

The operations of the modified portions in the vend control unit 11 shown in FIG. 11 will now be described. When one of the article selection signals $S_1$–$S_n$ has been stored in one of the SD flip-flops 48-1 through 48-n, the output of the NOR gate 49 is turned to "0". If, for example, the article selection signal $S_1$ has been stored in the SD flip-flop 48-1, the output of the SD flip-flops 48-1 is turned to "1" and this signal "1" is inverted whereby the output of the NOR gate 49 is turned to "0". At this time, the article selection signal $S_1'$ only which is outputted from the SD flip-flop 48-1 is "1" and the rest of the article selection signals, i.e., $S_2'$–$S_n'$ are all "0". In the NOR gates 120-1 through 120-n, a signal "1" (i.e., the article selection signal $S_l'$) is inputted to the sole NOR gate 120-1 corresponding to the selected article and input signals to the other NOR gates 120-2 through 120-n are all "0". Accordingly, the output of the NOR gate 34-1 remains to be "1" by application thereto of the output "0" of the NOR gate 120-1 whereby the storage of the SD flip-flop 32-1 (i.e., the vend possible signal $V_1$) is held therein. On the other hand, the output signals "1" of the NOR gates 120-2 through 120-n are applied to the NOR gates 34-2 through 34-n so that the outputs of the NOR gates 34-2 through 34-n are all turned to "0" and the contents stored in the SD flip-flops 32-2 through 32-n are all cleared. Thus, the storage of a single vend possible signal ($V_1$ in the above described example) corresponding to the selected article is maintained and the rest of the vend possible signals ($V_2$–$V_n$) are all cancelled. If, as a result of the "second comparison", the signal on the line 15 is turned to "1" in response to the retained vend possible signal ($V_1$), the storage of this vend possible signal ($V_1$) is further maintained until it is cancelled upon generation of the all-reset signal AR. If however, the signal on the line 15 is not turned to "1" in response to the retained vend possible signal ($V_1$) as a result of the second comparison, this signal ($V_1$) is immediately cancelled.

Figure 12:
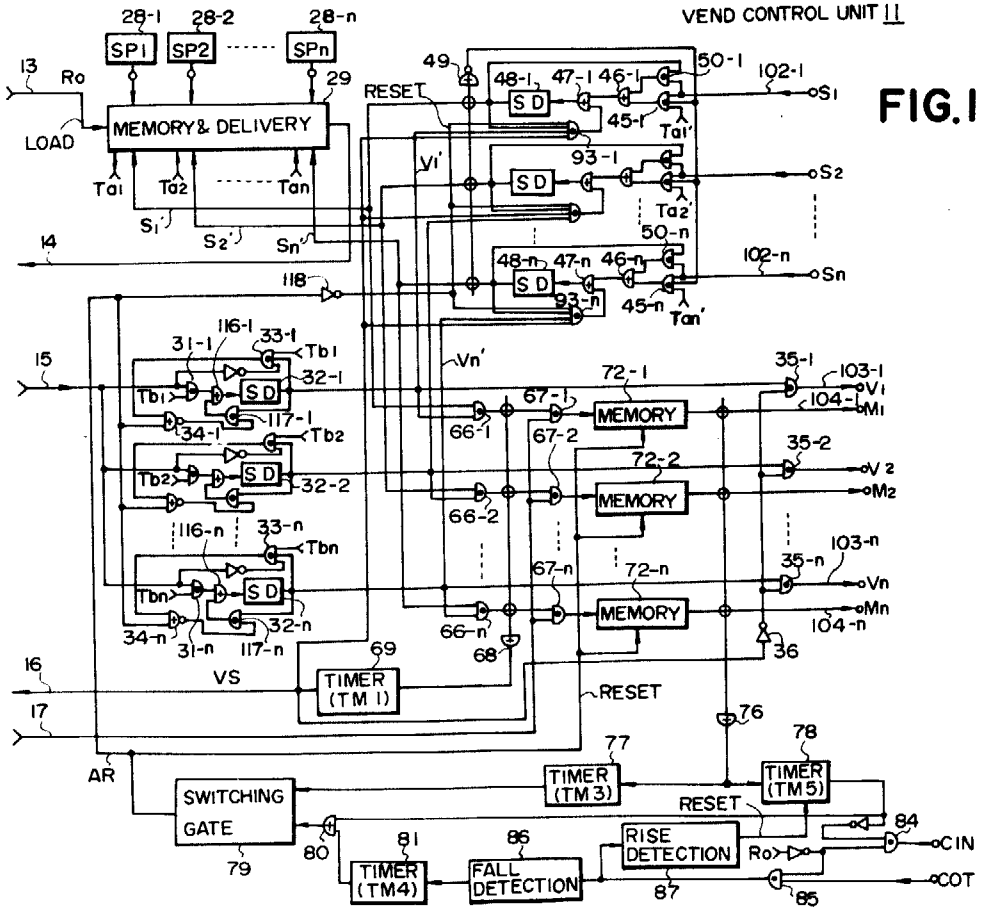

The vend control unit 11 shown in FIG. 12 is so arranged that the vend possible signals $V_1$–$V_n$ stored in the SD flip-flops 32-1 through 32-n are not cancelled at all when the article selection signals $S_1$–$S_n$ have been generated but a single vend possible signal only is held and the other vend possible signals are cancelled in accordance with the result of the second comparison. Difference between the vend control unit 11 in FIG. 12 and that in FIG. 1 is that the OR gate 51, the rise detection circuit 52 and the OR gate 53 shown in FIG. 1 are omitted in the circuit shown in FIG. 12.

In the circuit shown in FIG. 12, the vend possible signals $V_1$–$V_n$ stored in the SD flip-flops 32-1 through 32-n as a result of the first comparison are not cancelled at all when the article selection signals $S_1$–$S_n$ have been generated, for the SD flip-flops 32-1 through 32-n are reset only when the all-reset signal AR is "1" or the outputs of the AND gates 33-1 through 33-n are "0". Upon turning of the signal on the line 15 to "1" as a result of the second comparison, the vend possible signal (e.g. $T_1$) stored in the single SD flip-flop (e.g. 32-1) corresponding to the selected article is held and the rest of the vend possible signals ($V_2$–$V_n$) stored in the other SD flip-flops (e.g. 32-2 through 32-n) are all cancelled. Assume, for example, that a signal "1" has been stored in the SD flip-flop 32-1 zand 32-2 as a result of the first comparison and that the signal on the line 15 has been turned to "1" at a timing of the timing pulse $Tb_1$ as a result of the second comparison. In this case, the contents stored in the SD flip-flop 32-1 (i.e. the vend possible signal $V_1$) corresponding to the timing pulse $Tb_1$ is maintained at "1". Since the signal on the line 15 is "0" when the timing pulse $Tb_n$ is generated, the AND gate 117-n is disabled and, accordingly, the contents stored in the SD flip-flop 32-n (i.e., the vend possible signal $V_n$) is reset.

Figure 13:
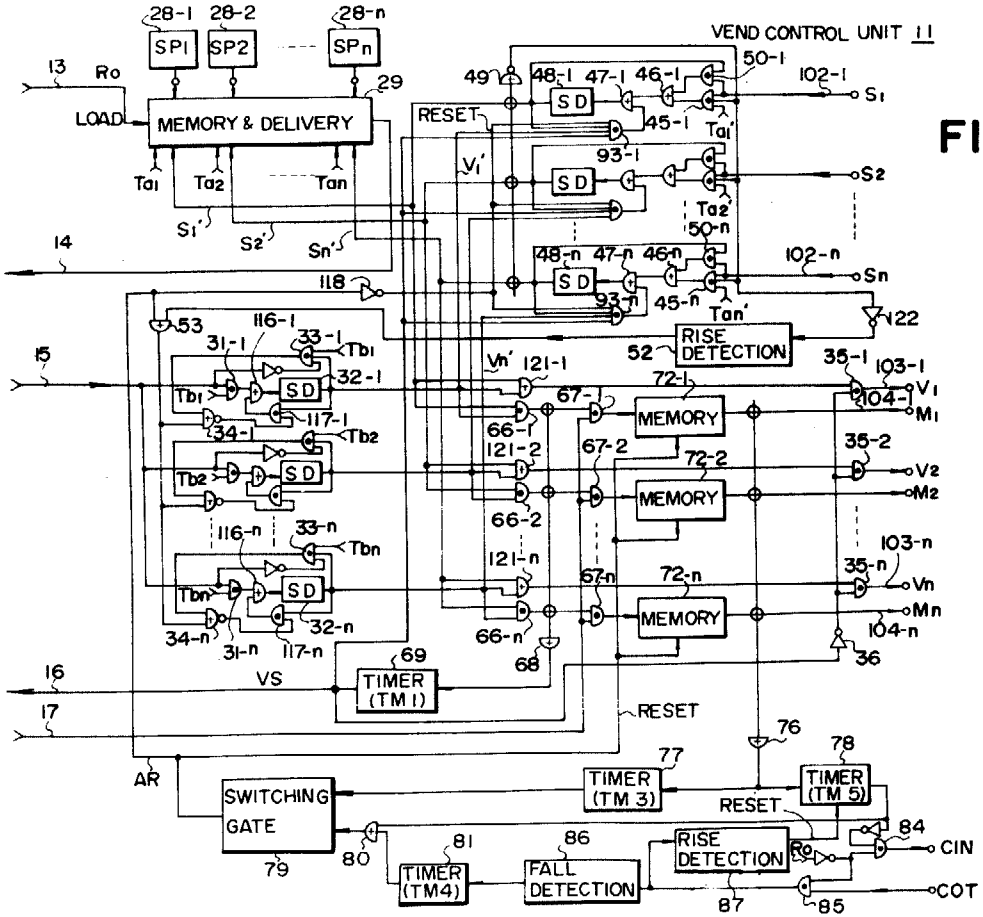

The vend control unit shown in FIG. 13 is so arranged that when one of the article selection signals ($S_1'$–$S_n'$) has been stored in one of the SD flip-flops 48-1 through 48-n, the vend possible signals $V_1$–$V_n$ stored in the SD flip-flops 32-1 through 32-n (i.e., the vend possible signals stored as a result of the first comparison) are all cancelled. Differences in construction between the vend control unit 11 shown in FIG. 13 and that shown in FIG. 1 are that the OR gate 51 in FIG. 1 is omitted and the output of the NOR gate 49 is applied to the rise detection circuit 52 through an inverter 122 in the circuit of FIG. 13 and that OR gates 121-1 through 121-n are additionally provided in the circuit of FIG. 13. The OR gates 121-1 through 121-n receive at one inputs thereof the outputs of the SD flip-flops 32-1 through 32-n and at the other input thereof the article selection signals $S_1'$–$S_n'$ outputted by the SD flip-flops 48-1 through 48-n. The outputs of the OR gates 121-1 through 121-n are delivered through AND gates 35-1 through 35-n as the vend possible signals $V_1$–$V_n$.

In the circuit shown in FIG. 13, upon storing of a single article selection signal (one of $S_1'$–$S_n'$) in one of the SD flip-flops 48-1 through 48-n, the output of the NOR gate 49 falls to "0" and the output of the inverter 122 thereby rises to "1". This causes the rise detection circuit 52 to produce one shot of pulse whereby the contacts stored in the SD flip-flops 32-1 through 32-n (i.e., the vend possible signals $V_1$–$V_n$ stored as a result of the first comparison) are all reset. One of the vend possible signals (one of $V_1$–$V_n$) corresponding to the selected article, however, remains uncancelled by application of a signal "1" corresponding to the single article selection signal (one of $S_1'$–$S_n'$) stored in one of the SD flip-flops 48-1 through 48-n to the OR gates 121-1 through 121-n.

Figure 14:
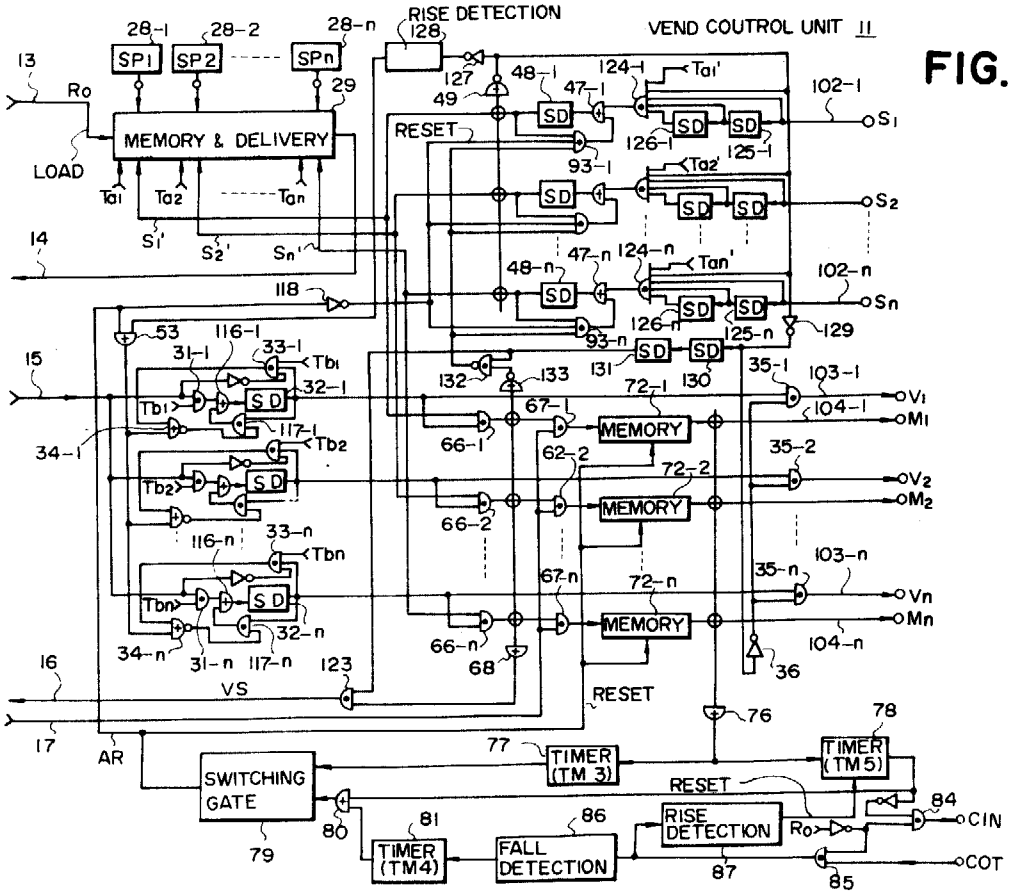

The vend control unit 11 shown in FIG. 14 is greatly different from that shown in FIG. 1 in the circuit portion for preferentially selecting the article selection signals $S_1$–$S_n$ and storing them in the SD flip-flops 48-1 through 48-n. Further, in the circuit shown in FIG. 14, an AND gate 123 is provided instead of the timer 69 (FIG. 1) and the output of this AND gate 123 is delivered on the line 16 as the vend start signal VS.

In FIG. 14, the article selection signals $S_1$–$S_n$ provided on line 102-1 through 102-n are applied to AND gates 124-1 through 124-n and also to SD flip-flops 125-1 through 125-n. The outputs of the SD flip-flops 125-1 through 125-n are applied to SD flip-flops 126-1 through 126-n and also to the AND gates 124-1 through 124-n. The AND gates 124-1 through 124-n receive at other inputs thereof the outputs of the SD flip-flops 126-1 through 126-n, timing pulses $Ta_1'$ through $Ta_n$-'and the output of the NOR gate 49, respectively. The outputs of the AND gates 124-1 through 124-n are applied to the SD flip-flops 48-1 through 48-n via the OR gates 47-1 through 47-n. By virture of this arrangement, the AND gates 124-1 through 124-n are not enabled immediately even if the article selection signals $S_1$–$S_n$ rise to "1" but are enabled only if the article selection signals are maintained at "1" for a longer time than 2 bit time which is a delay time provided by the SD flip-flops 125-1 through 125-n and 126-1 through 126-n. A single signal is selected from the article selection signals $S_1$–$S_n$ which are maintained at "1" for a certain time length through the AND gates 124-1 through 124-n and this selected signal "1" is stored in one of the SD flip-flops 48-1 through 48-n.

As one of the outputs of the SD flip-flops 48-1 through 48-n is turned to "1", the output of the NOR gate 49 falls to "0". This output of the NOR gate 49 is inverted by an inverter 127 and thereafter is applied to a rise detection circuit 128. This rise detection circuit 128 produces one shot of pulse upon falling of the output of the NOR gate 49 to "0". This pulse is inverted by the NOR gate 34-1 through 34-n through the OR gate 53 and applied to the SD flip-flops 32-1 through 32-n to reset the contents stored therein (i.e., the vend possible signals $V_1$–$V_n$). In this manner, the vend possible signals $V_1$–$V_n$ having been stored in the SD flip-flops 32-1 through 32-n as a result of the first comparison are all cancelled when the single article selection signal (one of $S_1'$–$S_n'$) has been stored in the SD flip-flops 48-1 through 48-n.

In the circuit shown in FIG. 1, the output of the timer 69 is applied to the inverter 36 which controls the operation of the AND gates 35-1 through 35-n, whereas in the circuit shown in FIG. 14, the output of an inverter 129 which inverts the output of the NOR gate 49 is applied to the inverter 36. If, accordingly, any one of the article selection signals $S_1'$–$S_n'$ is turned to "1", the output of the NOR gate 49 is tuned to "0", the output of the inverter 129 to "1" and the output of the inverter 36 to "0" thereby disabling the AND gates 35-1 through 35-n. The output of the inverter 129 is delayed by SD flip-flops 130 and 131 by 2 bit time and thereafter is applied to a NAND gate 132 and also to an AND gate 123. The AND gate 132 receives at the other input thereof the output of NOR gates 133 to which all of the outputs of the AND gates 66-1 through 66-n are applied. The AND gate 123 receives at the other input thereof the output of the OR gate 68 to which all of the outputs of AND gates 66-1 through 66-n are applied.

In the circuit shown in FIG. 1, the outputs of the SD flip-flops 32-1 through 32-n ($V_1'$–$V_n'$) and the output of the timer 69 are applied to the self-holding AND gates 93-1 through 93-n of the SD flip-flops 48-1 through 48-n, whereas in the circuit shown in FIG. 14, the output of a NAND gate 132 is applied to the AND gates 93-1 through 93-n. If any one of the gates 66-1 through 66-n is enabled upon receipt of the signal "1" stored in any one of the SD flip-flops 32-1 through 32-n and the article selection signals $S_1'$–$S_n'$ as a result of the second comparison, the output of the OR gate 68 is turned to "1" and the output of the NOR gate 133 to "0". The output of the NAND gate 132 thereby is maintained at "1" and the article selection signals $S_1'$–$S_n'$ stored in the SD flip-flops 48-1 through 48-n are sustained. As a signal "1" which is obtained by inverting the output of the NOR gate 49 by the inverter 129 has been outputted from the SD flip-flop 131 as a delayed output, the AND gate 123 is enabled and, accordingly, the vend possible signal is turned to "1" and this signal "1" is supplied to the coin control unit 10 (FIG. 1) through the line 16. If the second comparison produces a result that vending is not possible, the AND gates 66-1 through 66-n are not enabled but the output of the NAND gate 132 is turned to "0" when the output of the SD flip-flop 131 is turned to "1" and the NAND gate 132 thereby receives a signal "1" at the two inputs thereof. In this case, the contents stored in the SD flip-flops 48-1 through 48-n (i.e., $S_1'$–$S_n'$) are cleared by the output "0" of the NAND gate 132. The vend start signal Vs is not generated.

Figure 15:
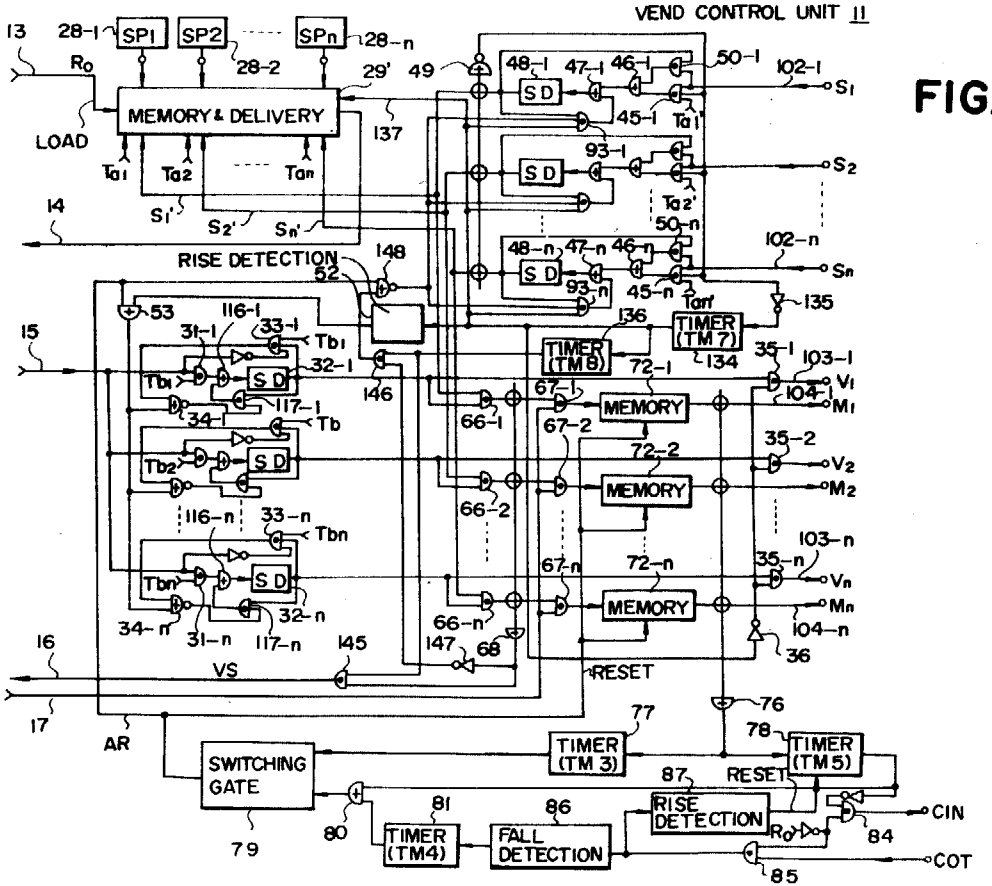

In the vend control unit 11 shown in FIG. 15, contents stored in the SD flip-flops 32-1 through 32-n (i.e., the vend possible signals $V_1$–$V_n$ produced as a result of the first comparison) are reset upon lapse of a preset time from the time when the single article selection signal (one of $S_1'$–$S_n'$) is stored in the SD flip-flops 48-1 through 48-n and the second comparison is conducted thereafter. In the circuit shown in FIG. 1, the output of the OR gate 51 is applied to the rise detection circuit 52, whereas in the circuit shown in FIG. 15, the OR gate 51 is omitted and the output of a timer 134 is applied to the rise detection circuit 52. To the timer 134 is applied a signal obtained by inverting the output of the NOR gate 49 by an inverter 135. If a single signal (one of $S_1'$–$S_n'$) among the article selection signals $S_1$–$S_n$ has been stored in any one of te SD flip-flops 48-1 through 48-n, the output of the NOR gate is turned to "0" and the output of the inverter 135 to "1" so that a signal "1" is applied to the timer 134. The timer 134 outputs an applied signal after delaying it by a preset time length $TM_7$.

The output of the timer 134 is applied to self-holding AND gates 93-1 through 93-n of the SD flip-flops 48-1 through 48-n and also to the rise detection circuit 52, timer 136 and inverter 36. The output of the timer 134 is further applied to a memory and delivery circuit 29, through a line 137. Even if the output of any one of the SD flip-flops 48-1 through 48-n has risen to "1", the self-holding AND gates 93-1 through 93-n are not enabled until the delay time $TM_7$ set by the timer 134 has elapsed. Until then, the contents stored in the SD flip-flops 48-1 through 48-n are maintained by the output of the AND gates 50-1 through 50-n under the condition that one of the article selection signals $S_1'$–$S_n'$ corresponding to the preferentially selected single article selection signal (one of $S_1'$–$S_n'$) is sustained at "1". Upon lapse of the time $TM_7$, the output of the timer 134 is turned to "1" and the AND gates 93-1 through 93-n therefore are enabled. Accordingly, the single article selection signal ($S_1'$-$S_n'$) is held even after disappearance of the article selection signals $S_1$-$S_n$. The operation time $TM_7$ of the timer 134 is set to be long enough to receive the normal article selection signals $S_1$-$S_n$. Alternatively stated, the time $TM_7$ is so determined that the SD flip-flops 48-1 through 48-n do not respond to false article selection signals $S_1$-$S_n$ of a very short time length which may be generated due to noise but hold only the normal article selection signals $S_1$-$S_n$ which are generated when the article selection signal (38 in FIG. 1) is actually depressed.

When the output of the timer 134 has risen to "1", the rise detection circuit 52 produces one shot of pulse. The NOR gates 34-1 through 34-n therefore receive a signal "1" through the OR gate 53 and the contents stored in the SD flip-flops 34-1 through 34-n (i.e., the vend possible signals $V_1$-$V_n$ stored as a result of the first comparison) are all cancelled. As the output signal "1" of the timer 134 is applied to the memory and delivery circuit 29' through the line 137, a single vend price signal (one of $SP_1$-$SP_n$) corresponding to the single article selection signal (one of $S_1'$-$S_n'$) which is "1" only is read from the circuit 29. Thus, the single vend price signal corresponding to the selected article only is supplied to the comparison circuit 26 (FIG. 1) in the coin control unit 10 through the line 14 whereby the above described second comparison is effected.

Figure 16:
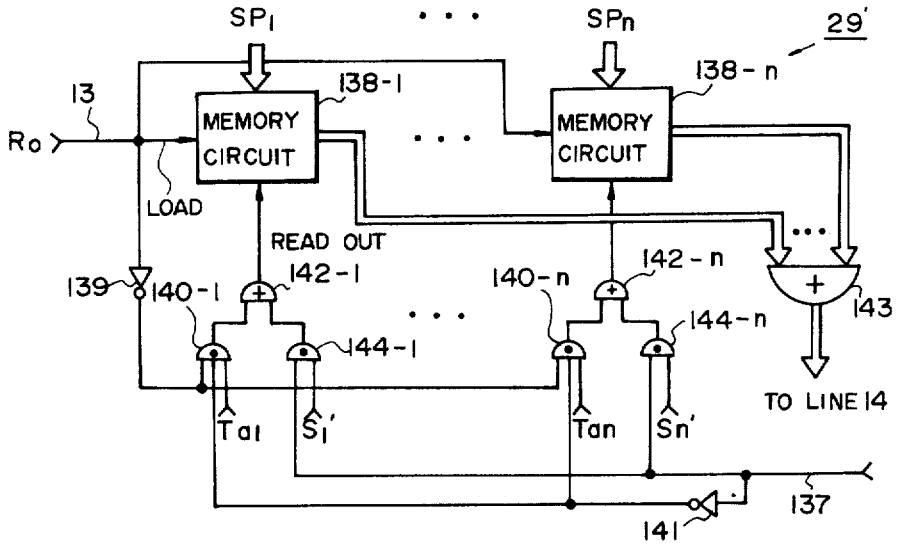
FIG. 16 is a circuit diagram showing an example of a memory and delivery circuit shown in FIG. 15.

The function of the memory and delivery circuit 29' is different from that of the circuit 29 in that all of the vend price signals $SP_1$-$SP_n$ are read out when the signal on the line 137 is "0" whereas a single vend price signal (one of $SP_1$-$SP_n$) corresponding to the selected article selection signal (one of $S_1'$-$S_n'$) is read out when the signal on the line 137 is "1". An example of this memory and delivery circuit 29' is shown in FIG. 16. In FIG. 16, when the all-zero signal $R_0$ on the line 13 is "1", i.e., when the vending machine is in the stand-by mode, the vend price signals $SP_1$-$SP_n$ are loaded in memory circuits 138-1 through 138-n. Upon turning of the all-zero signal $R_0$ to "0" by deposition of the coin, the output of an inverter 139 is turned to "1" and AND gates 140-1 through 140-n are enabled. At this time, the signal being supplied on the line 137 from the timer 134 (FIG. 15) is "0" and an output signal "1" of an inverter 141 which has inverted the signal "0" on the line 137 is applied to AND gates 140-1 through 140-n. The 3-input-type AND gates 140-1 through 140-n receive at the remaining inputs thereof the time division timing pulses $Ta_1$--$Ta_n$ respectively. The outputs of the AND gates 140-1 through 140-n are applied to readout control inputs of the memory circuits 138-1 through 138-n through OR gates 142-1 through 142-n. Accordingly, the vend price signals $SP_1$-$SP_n$ initially are successively read from the memory circuits 138-1 through 138-n in accordance with the time division timing pulses $Ta_1$-$Ta_n$ and provided on the line 14 through an OR combination circuit 143 as time division multiplexing signals. Thus, the first comparison can be made in the comaprison circuit 26 (FIG. 1) of the coin control unit 10.

Upon turning of the signal provided on the line 137 by the timer 134 (FIG. 15) to "1", the AND gates 140-1 through 140-n are disabled and AND gates 144-1 through 144-n are enabled. The AND gates 144-1 through 144-n receive at the other inputs thereof the article selection signals $S_1'$-$S_n'$. Accordingly, a signal "1" is put out from one of the AND gates 144-1 through 144-n corresponding to a single article selection signal (one of $S_1'$-$S_n'$) which is "1" and applied to a corresponding one of the memory circuits 138-1 through 138-n through one of OR gates 142-1 through 142-n. A single vend price signal (one of $SP_1$-$SP_n$) corresponding to the selected article only is delivered on the line 14. The second comparison is conducted in response to this single vend signal (one of $SP_1$-$SP_n$). Since in the example shown in FIG. 16 the single vend price signal corresponding to the selected article is continuously read out, the timing pulses $Tb_1$-$Tb_n$ are fixed as in the case of the example shown in FIG. 4.

Reverting to FIG. 15, the output of the inverter 36 is turned to "0" when the output of the timer 134 is turned to "1" and the AND gates 35-1 through 35-n thereby are disabled. Accordingly, the vend possible signals $V_1$-$V_n$ are not generated even if a signal "1" is stored in one of the SD flip-flops 32-1 through 32-n as a result of the second comparison.

Upon lapse of a delay time $TM_8$ of the timer 136 from turning of the output "1" of the timer 134 to "1", the output of the timer 136 rises to "1". The delay time $TM_8$ of the timer 136 is set to have sufficient length to effect the second comparison. Accordingly, the second comparison has already been completed when the output of the timer 136 has risen to "1" and, if it has been confirmed by the second comparison that the selected article is vendible, the output of the single AND gate (one of 66-1 through 66-n) corresponding to the selected article has risen to "1". The outputs of the AND gates 66-1 through 66-n are applied to an AND gate 145. The AND gate 145 receives at another input thereof the output of the timer 136. If, accordingly, the selected article has been found vendible, the AND gate 145 is enabled and an output signal "1" of the AND gate 145 is supplied to the coin control unit 10 (FIG. 1) through the line 16 as the vend start signal VS.

On the other hand, the output of the timer 136 is applied to an AND gate 146. The AND gate 146 receives at the other input thereof a signal obtained by inverting the output of the OR gate 68 by an inverter 147. If the selected article has been found unvendible as a result of the second comparison, the output of the OR gate 68 is "0" when the output of the timers 136 has risen to "1" so that the output of the inverter 147 is "1" and the AND gate 146 thereby is enabled. The output "1" of the AND gate 146 is inverted by a NOR gate 148 so that a signal "0" is applied to the AND gates 93-1 through 93-n and the article selection signals $S_1'$-$S_n'$ which have been self-held in the AND gates 93-1 through 93-n are instantly cleared. In this case, the AND gate 145 is not enabled and the vend possible signal VS is not generated.

In case the AND gate 145 is enabled, the AND gate 146 is not enabled. In that case, clearing of the article selection signals $S_1'$-$S_n'$ is effected when the all-reset signal AR applied to a NOR gate 148 is turned to "1", i.e., when the vending operation has been completed.

Figure 17:
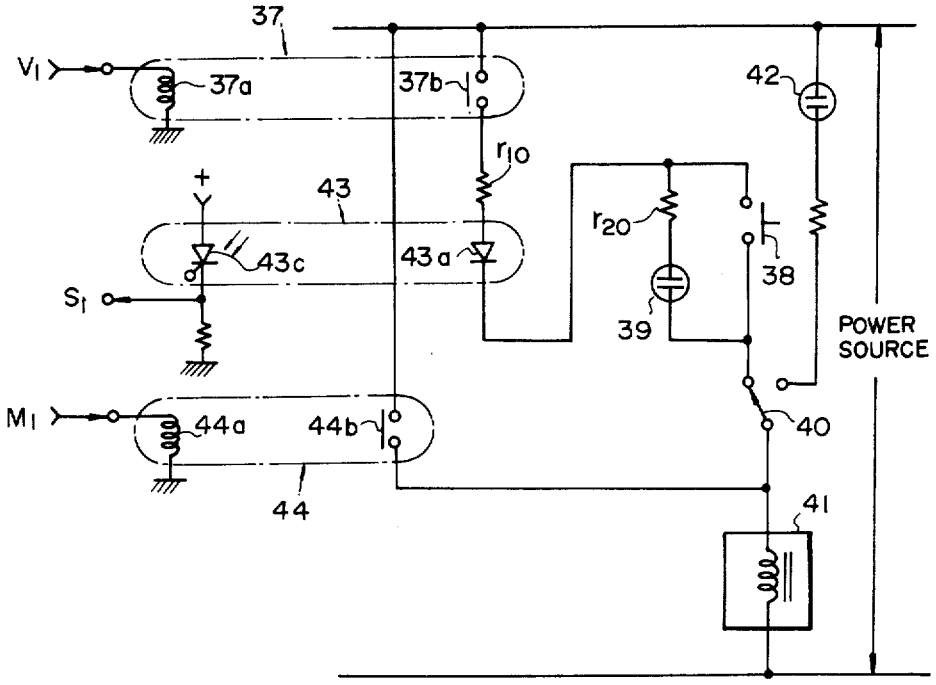
FIGS. 17 and 18 are circuit diagrams showing modifications of the circuit shown in FIG. 3.
Figure 18:
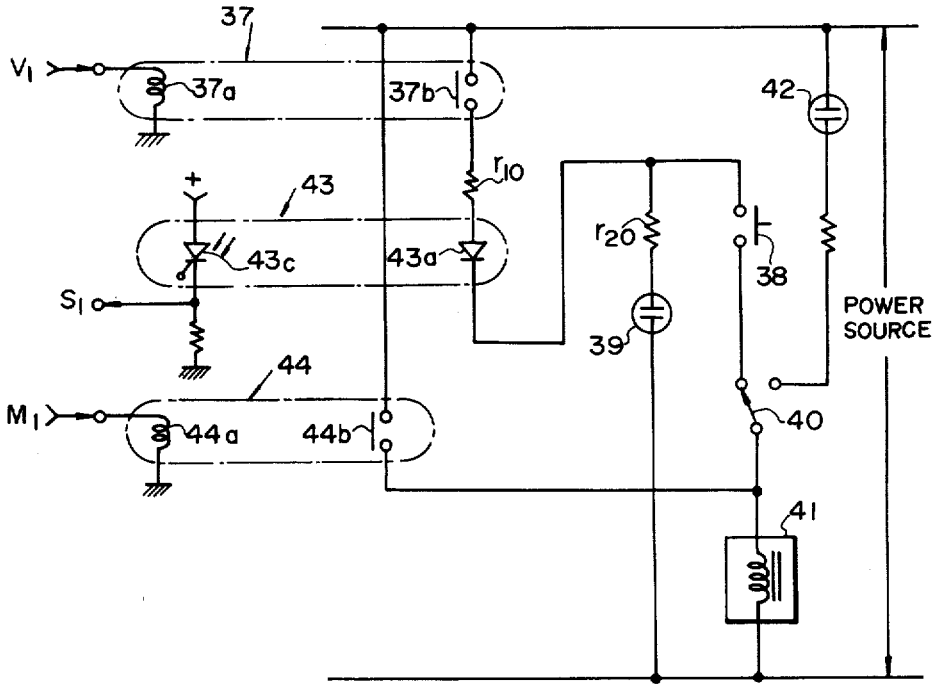

Modified examples of the circuit for selecting and dispensing the article shown in FIG. 3 are shown in FIGS. 17 and 18. In FIG. 3, turning off of either the relay contact 37 or the article selection switch 38 controlled by the vend possible signal $V_1$ causes the light-emitting diode **43*a* to be turned on. This in turn brings the transistor 43*b* into conduction to cause the article selection signal $S_1$ to be turned to "0". In the example shown in FIGS. 17 and 18, a photo SCR 43*c* is employed as a light receiving element for the photo coupler 43 instead of the photo transistor 43b so that once the vend possible signal $V_1$ has been generated and the photo SCR 43c has been triggered in response to depression of the article selection switch 38, the article selection signal $S_1$ continues to be generated even if the vend possible signal $V_1$ has been cancelled. In FIGS. 17 and 18, the circuit elements performing the same functions as those shown in FIG. 3** are designated by the same reference characters and detailed description thereof is omitted.

Description will now be made about the circuit shown in FIG. 17. The circuit of FIG. 17 is featured by arrangements that the contact 37b, resistor $r_{10}$ and light-emitting diode 43a are connected in series to a parallel circuit of the article selection switch 38 and the vend possible lamp 39 and that the photo SCR 43c is used as a light receiving element for the photo coupler 43. The resistance value of a resistor $r_{20}$ which is connected to the resistor $r_{10}$ and the vend possible lamp 39 is set at such a value that current flowing through the light emitting diode 43a is restricted to such an extent that a sufficient amount of light is not obtained to trigger the photo SCR 43c when the current flows through both the resistor $r_{10}$ and the resistor $r_{20}$ whereas a sufficient amount of light is emitted to trigger the photo SCR 43c when the current is caused to flow through the light-emitting diode 43a through only the resistor $r_{10}$ short-circuiting the resistor $r_{20}$ by turning on of the article selection switch 38.

In the stand-by mode, both the contact 37b and the article selection switch 38 are off and the light-emitting diode 43a is not lighted. Accordingly, the photo SCR 43c is off and the article selection $S_1$ is "0". As the vend possible signal $V_1$ provided by the coin control unit 11 (FIG. 1) is turned to "1" by deposition of a coin or coins in a preset amount or over that amount, the relay coil 37a is energized and the contact 37B is closed. This enables a small current to flow through the contact 37b, resistor $r_{10}$, light-emitting diode 43a, resistor $r_{20}$, vend possible lamp 39, run-out detection switch 40 and article dispensing drive unit 41. A sufficient amount of light however is not obtained by the diode 43a to trigger the photo SCR 43c, for, as described previously, the flowing of the current is restricted by the resistors $r_{10}$ and $r_{20}$, so that the article selection signal $S_1$ remains to be "0". The drive unit therefore is not driven and the vend possible lamp 39 only is lighted. As the purchaser has depressed the article selection switch 38 upon recognizing lighting of the vend possible lamp 39, the circuit between the resistor $r_{20}$ and the lamp 39 is short-circuited by turning on of the switch 38. The current flowing through the light-emitting diode 43a therefore is no longer subjected to the restriction posed by the resistor $r_{20}$ and a sufficient amount of light thereby is obtained. The photo SCR therefore is triggered and brought into conduction and the article selection signal $S_1$ outputted from the cathode of the photo SCR 43c is turned to "1".

In the vend control unit 11 shown in FIG. 1, the SD flip-flops 32-1 through 32-n are once reset through the OR gate 51, the rise detection circuit 52 and the OR gate 53 by turning of the article selection signal $S_1$ to "1". The vend possible signal $V_1$ thereby is turned to "0" and the contact 37b in FIG. 17 is turned off. The light-emitting diode 43a therefore is extinguished but the triggered photo SCR maintains its conductive state. Accordingly, the vend possible signal $S_1$ is maintained at "1" even after cancellation of the vend possible signal $V_1$.

This arrangement is advantageous in that the single article selection signal (one of $S_1$–$S_n$) can be selectively held for a sufficient length of time in one of the SD flip-flops 48-1 through 48-n (FIG. 1) of the vend control unit 11.

In the circuit shown in FIG. 17, flowing of the current through the vend possible lamp 39 is entirely stopped when the article selection switch 38 has been turned on and the lamp 39 is immediately extinguished. If the circuit of the resistor $r_{20}$ and the vend possible lamp 39 is connected in parallel to the circuit of the switches 38 and 40 and the drive unit 41 as shown in FIG. 18, the lamp 39 can be continuously lighted while the article selection signal 38 is being depressed. In FIG. 18, potential difference to some degree is produced in the drive unit 41 when the article selection switch 38 is turned on, so that a small current flows through the vend possible lamp 39 provided in parallel therewith causing the lamp 39 to be continuously lighted.

In FIGS. 17 and 18, the photo SCR 43c has only to be turned off upon completion, for example, of the first vending operation. For this purpose, a signal obtained by inverting the all-reset signal AR outputted by the switching gate 79 shown in FIG. 1 is applied to the anode of the photo SCR 43c. According to this arrangement, since the all-reset signal AR is "0" during the vending operation, the inverted signal "1" is applied to the anode of the photo SCR 43c as a forward bias source (+) thereby securing conduction of the photo SCR 43c, whereas by turning of the all-reset signal R to "1" upon completion of the vending operation, the photo SCR 43c is reversely biased and thereby is turned off.

The purpose of the circuit shown in FIGS. 17 and 18 may be achieved by employing a circuit which consists of a combination of photo transistor and a bistable circuit instead of the photo SCR 43c.

FIGS. 3, 17 and 18 show the example in which the solenoid SOL, is used as the drive unit 41 and FIG. 6 shows the example in which the motor $MT_1$ is used. The construction of the drive unit 41, however, is not limited to these examples. For example, the present invention is applicable to a case wherein a single motor is commonly used by switching solenoids ($SOL_1$–$SOL_n$) corresponding to respective articles. An example each of the vend control unit 11 and a circuit on the vend mechanism side is schematically shown in FIG. 19.

Figure 19:
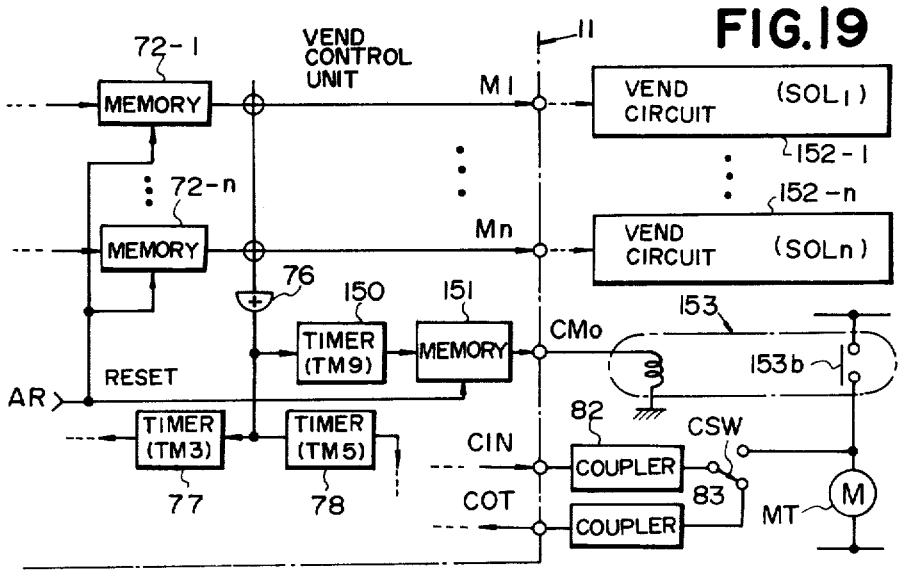
FIG. 19 is a block diagram showing modified parts of the vend control units shown in FIG. 1 and FIGS. 11 through 15 and omitting an example of the circuit of the vend mechanism corresponding to the modification.

The vend control unit 11 shown in FIG. 19 comprises a timer 150 and a memory circuit 151 in addition to the vend control unit 11 of FIG. 1 or FIGS. 11–15 and is entirely the same as the vend control unit 11 of FIG. 1 or FIGS. 11–15 in other respects. For illustrating points at which the timer 150 and the memory circuit 151 are to be connected, the OR gate 76, timers 77 and 78 and the memory circuits 72-1 and 72-n only are illustrated and illustration of the rest of the circuit components is omitted. The respective circuits 152-1 through 152-n are entirely of the same construction as those shown in FIGS. 3, 17 and 18 and employs solenoids $SOL_1$–$SOL_n$ as the drive unit 41. As a driving source for dispensing an article, a single motor MT is provided. When a motor drive signal CMo has been put out by the memory circuit 151, a contact 153b of a coupler 153 is closed and the motor MT thereby is driven. The selected article is dispensed by the driving of the motor MT from an article delivery column (not shown) corresponding to a single vending circuit (one of the circuit 152-1 through 152-n) whose solenoid (one of $SOL_1$–$SOL_n$) is energized. The coupler 82 for the CIN signal and the coupler 83 for the COT signal are of the same construction as those shown in FIG. 6.

Upon turning of the vend drive signal (one of $M_1$-$M_n$) corresponding to the selected article to "1", a corresponding one of the solenoids $SOL_1$-$SOL_n$ is energized. Simultaneously, the output of the OR gate 76 is turned to "1" and thereafter is applied to the timer 150. The timer 150 outputs the applied signal "1" after delaying it by a delay time $TM_9$. The signal "1" outputted from the timer 150 is stored in the memory circuit 151. Accordingly, the motor drive signal CMo outputted by the memory circuit 151 is turned to "1" and this causes the contact 153*b* of the coupler 153 to be closed to drive the motor MT. Rotation of the motor MT by a predetermined angle causes the carrier switch SCW to be changed over from the illustrated position to the motor side and the driving of the motor MT is ensured by a signal produced by this carrier switch SCW. Simultaneously, the COT signal falls to "0" and the all-reset signal AR is generated upon lapse of the delay time $TM_4$ of the timer 81 (FIG. 1, FIGS. 11 through 15), as was previously described with reference to FIG. 7. This all reset-signal AR is applied to a reset input of the memory circuit 151 and the motor drive signal CMo falls to "0". The contact 153*b* thereby is opened but the motor MT continues to be driven until the carrier switch SCW is turned off and a single selected article is dispensed from the article delivery column corresponding to the vend circuit (one of 152-1 through 152-n) whose solenoid (one of $SOL_1$-$SOL_n$) is energized.

The timer 150 is provided so that the motor drive signal CMo is generated not immediately upon rising of the vend drive signals $M_1$-$M_n$ but after preparation for dispensing the selected article has been completed in one of the article delivery columns by ensuring energizing of one of the solenoids $SOL_1$-$SOL_n$ by the vend drive signals $M_1$-$M_n$. The delay time $TM_9$ of the timer 150 is set, for example, at about 150 ms. In the circuit shown in FIG. 19, the switching gate 79 (FIG. 1, FIGS. 11-15) selects the output of the OR gate 80 as the all-reset signal AR.

The above description has been made about the embodiment in which the device according to the invention is constructed of a fixed circuit. The invention can be carried out, however, by employing a microcomputer comprising general type CPU, ROM, RAM etc. and writing a programme for performing the functions of the device according to the invention in the ROM of such microcomputer. It will also be noted that the example shown in FIG. 1 is so constructed that it will be applicable either to a case where the solenoid is used as the drive unit 41 or to a case where the motor is used as the drive unit 41 by switching the switching gate 79. If this example is to be applied only to the case where the solenoid is used, the timer 77 only may be provided and the circuits 78-81 and 84-89 are unnecessary, whereas if the example is to be applied only to the case where the motor is used, the circuits 78, 80, 81, 84-87 only may be provided and the timer 77 and the gate 79 are unnecessary.

In the embodiments described above, the signals $SP_1$-$SP_n$, $S_1$-$S_n$, $V_1$-$V_n$, $M_1$-$M_n$ which are inputted to and outputted from the vend control unit 11 (FIG. 1, FIGS. 11-15 and FIG. 19) are shown in such a manner that the respective signals are inputted and outputted in parallel. It will be understood, however, that arrangements may be made such that these signals are inputted and outputted in a time division multiplexing manner. Especially, in case where the vend control unit 11 (and also the coin control unit 16) are made by an integrated circuit, arrangements will naturally be made so that the signals $V_1$-$V_n$ and $M_1$-$M_n$ will be outputted after being multiplexed in the vend control unit 11 composed of the integrated circuit and the signals $SP_1$-$SP_n$ and $S_1$-$S_n$ also will be inputted after being multiplexed in the outside circuit whereby the number of pins used for input and output terminals of the integrated circuit will be reduced. In this case, a circuit for demultiplexing the multiplexed signals $V_1$-$V_n$, $M_1$-$M_n$ etc. outputted from the vend control unit 11 and restoring these signals to parallel signals and a circuit for multiplexing the signals $SP_1$-$SP_n$, $S_1$-$S_n$ etc. to be inputted to the vend control unit 11 need to be additionally provided outside of the vend control unit 11 composed of the integrated circuit.

What we claim is:

1. A control device for a vending machine comprising counter means for adding amounts of deposited coins together and subtracting a price of an article to be vended and an amount of paid out coins from a total amount of the deposited coins, comparator means for comparing present contents of said counter means with a set vend price of an article, vend price setting means for presetting vend prices of respective articles, article selection switches corresponding to the respective articles and vend circuits corresponding to the respective articles for dispensing the articles in response to a vend drive signal characterized in that said control device further comprises vend control means which comprises:

vend price signal delivery means which delivers signals representing the set vend prices of all articles having been set by said vend price setting means to said comparator means during a first operation and delivers only a signal representing the vend price of the single article selected by said article selection switch during a second operation;

vend possible signal delivery means which delivers out, during said first operation, one or more vend possible signals corresponding to one or more vendible articles which have been detected by said comparator means;

vend drive signal delivery means which supplies, during said second operation, a vend drive signal corresponding to the single article which has been found vendible by said comparator means to said vend circuits; and operation control means which judges whether said first operation is to be made or said second operation is to be made, causing said first operation and said second operation to be performed sequentially, and controls said respective signal delivery means in accordance with the judgement;

the operation of said article selection switch or switches being made effective by said vend possible signals and the article being dispensed by said vend drive signal.

2. A control device for a vending machine as defined in claim 1 wherein said operation control means judges whether said first operation is to be made or said second operation is to be made depending upon whether any one of said article selection switches has been effectively operated or not, causing said first operation to be performed before said one of the article selection switches has been effectively operated and causing said second operation to be performed after said one of the article selection switches has been effectively operated.

3. A control device for a vending machine as defined in claim 2 wherein said operation control means is a circuit which receives outputs of the article selection switches corresponding to respective articles and preferentially selects and stores one of the article selection signals produced by operation of the article selection switches with respect to a single article, said vend price signal delivery means is a circuit which delivers out signals representing set vend prices of all article if said article selection signal is not stored and delivers out a signal representing a single vend price corresponding to the single article selection signal if said single article selection signal is stored, said vend possible signal delivery means comprises a vend possible memory circuit for separately storing the signals put out by said comparator means each representing that a particular article is vendible and gate means for delivering out the contents of said vend possible memory circuit as the vend possible signals if said article selection signal is not stored.

said vend drive signal delivery means comprises a circuit which, if said article selection signal is stored, selects single data corresponding to the article stored in said vend possible memory circuit and produces a vend start signal if the data represents that the article is vendible and a vend drive signal memory circuit which stores the vend start signal with respect to the article for which said article selection signal is stored and delivers out the stored contents as the vend drive signal, and said vend start signal is utilized as a control signal for subtracting the set vend price of the single article delivered from said vend price signal delivery means in said counter means.

4. A control device for a vending machine as defined in claim 3 wherein said vend control means further comprises timer means for delaying timing of storing the vend drive signal and timing of the subtraction relative to timing of generating the vend start signal thereby to prevent occurrence of an erroneous operation and reset means for generating a reset signal at a suitable timing after delivering of the vend drive signal to reset said operation control means, said vend possible memory circuit and said vend drive signal memory circuit.

5. A control device for a vending machine as defined in claim 1 wherein each of the article selection switches outputs a signal representing that an article selection operation has been made if the vend possible signal corresponding to the article selection switch is present during operation of the article selection switch whereby the operation of the selection switch is made effective.

6. A control device for a vending machine as defined in claim 3 wherein said vend price signal delivery means comprises a memory circuit for receiving and storing, in a stand-by mode, signals representing the set vend prices of the respective articles set by said vend price setting means and a readout circuit for sequentially reading, in time division, the signal representing set vend prices of the respective articles from said memory circuit if the article selection signal is not stored and reading a signal representing a single set vend price corresponding to the selected article from said memory circuit if the article selection signal is stored, said comparator means is a single comparator comparing the set vend price signals read out in time division with the contents of said counter means, and said vend possible memory circuit comprises memory circuits corresponding to the respective articles and a control circuit for distributing the signals representing the vendible articles put out by said comparator to said memory circuits corresponding to the respective articles in synchronism with the timing of the time division reading for having these signals stored in said memory circuits.

7. A control device for a vending machine as defined in claim 1 wherein each of said vend circuits comprises an article dispensing drive unit e.g. a motor or a solenoid, a circuit for supplying current to drive said article dispensing driving unit in response to the vend drive signal, a closed loop circuit for supplying said drive unit with a small current which is not sufficient to drive said drive unit and detection means for detecting presence or absence of current in the closed loop circuit, and said vend control means further comprises malfunction detection means for inhibiting delivery of the vend possible signal and the vend drive signal with respect to any of the vend circuits in which no current has been detected by said malfunction detection means during the stand-by mode.

8. A control device for a vending machine as defined in claim 6 wherein respective constituent elements are arranged in three parts of a first integrated circuit unit including said counter means and comparator means, a second integrated circuit unit including said vend control means, and a vend circuit section including said article selection switches and said vend circuits, wiring are provided from said first integrated circuit unit to said second integrated circuit for delivering a signal representing the stand-by mode in which the contents of said counter means are 0, the output signal of said comparator means and a signal representing that said counter means has entered a vend price subtraction mode, wirings are provided from said second integrated circuit unit to said first integrated circuit unit for delivering signal representing the set vend price and the vend start signal, and wirings are also provided between said second integrated circuit unit and said vend circuit section for delivering or receiving the vend possible signal, the vend drive signal and the output signals of the article selection switches.

9. A control device for a vending machine comprising counter means for adding amounts of deposited coins together and subtracting a price of an article to be vended and an amount of paid out coins from a total amount of the deposited coins, comparator means for comparing present contents of said counter means with a set vend price of an article, vend price setting means for presetting vend prices of respective articles, article selection switches corresponding to the respective articles, vend possible indicators provided corresponding to the respective article selection switches, and vend circuits corresponding to the respective articles for dispensing the articles in response to a vend drive signal characterized in that said control device further comprises vend control means which comprises:

operation control means which judges whether a first operation is to be made or a second operation is to be made depending upon whether any one of said article selection switches has been operated or not, causing said first operation to be performed before said one of the article selection switches has been operated and causing said second operation to be performed after said one of the article selection switches has been operated;

vend price signal delivery means which delivers signals representing the set vend prices of all articles having been set by said vend price setting means to said comparator means during said first operation and delivers only a signal representing the vend price of the single article selected by said article selection switch during said second operation;

vend possible signal delivery means which delivers out, during said first operation, one or more vend possible signals corresponding to one or more vendible articles which have been detected by said comparator means for driving one or more of said vend possible indicators in response to said vend possible signal or signals; and vend drive signal delivery means which supplies, during said second operation, a vend drive signal corresponding to the single article which has been found vendible by said comparator means to said vend circuits.

* * * * *